US006363738B2

(12) United States Patent
Nakajima et al.

(10) Patent No.: US 6,363,738 B2
(45) Date of Patent: Apr. 2, 2002

(54) REFRIGERATOR

(75) Inventors: Narumi Nakajima; Hidekazu Tonooka, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/809,000

(22) Filed: Mar. 16, 2001

(30) Foreign Application Priority Data

Mar. 27, 2000 (JP) ..... 2000-086488
Aug. 4, 2000 (JP) ..... 2000-236993

(51) Int. Cl.[7] ..... F25D 11/02
(52) U.S. Cl. ..... 62/440; 312/408; 211/1.56
(58) Field of Search ..... 62/440; 312/408, 312/306, 312; 211/1.51, 1.52, 1.56

(56) References Cited

U.S. PATENT DOCUMENTS 2,812,104 A * 11/1957 Larsen ..... 211/1.56
2,861,695 A * 11/1958 Carbary ..... 211/1.56
3,389,804 A * 6/1968 Lyon ..... 211/1.56
4,699,276 A * 10/1987 Kis ..... 211/1.56
5,944,202 A * 8/1999 Wylie ..... 211/1.56
6,220,457 B1 * 4/2001 Resta ..... 211/1.56

FOREIGN PATENT DOCUMENTS

JP 2752300 2/1998

* cited by examiner

*Primary Examiner*—William E. Tapolcai
*Assistant Examiner*—Mohammad M Ali
(74) *Attorney, Agent, or Firm*—Oblon, Spivak, McClelland, Maier & Neustadt, P.C.

(57) ABSTRACT

A shelf placing frame formed in a hollow shape and a timing belt arranged along its periphery utilizing the hollow part are prepared. A lever movable along the frame is fixedly connected to the timing belt so as to rotationally move the timing belt. A screw shape shaft fixedly provided with a gear disposed rotational moving line of the timing belt is provided in the frame and conjointly moved with the timing belt. A moving board having a screw threaded hole meshing with the screw shape shaft is fixed on an inner wall of a refrigerator so that the shelf placing frame is moved up and down in accordance with movement of the lever.

27 Claims, 28 Drawing Sheets

FIG. 1
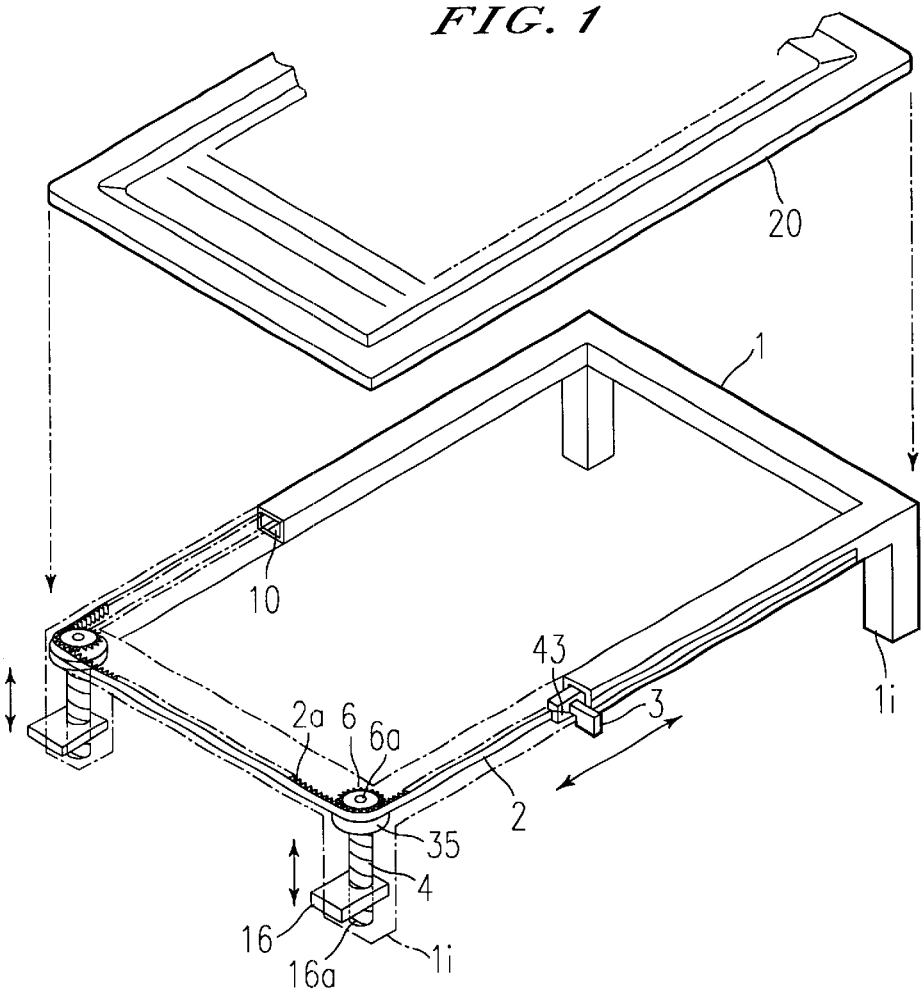
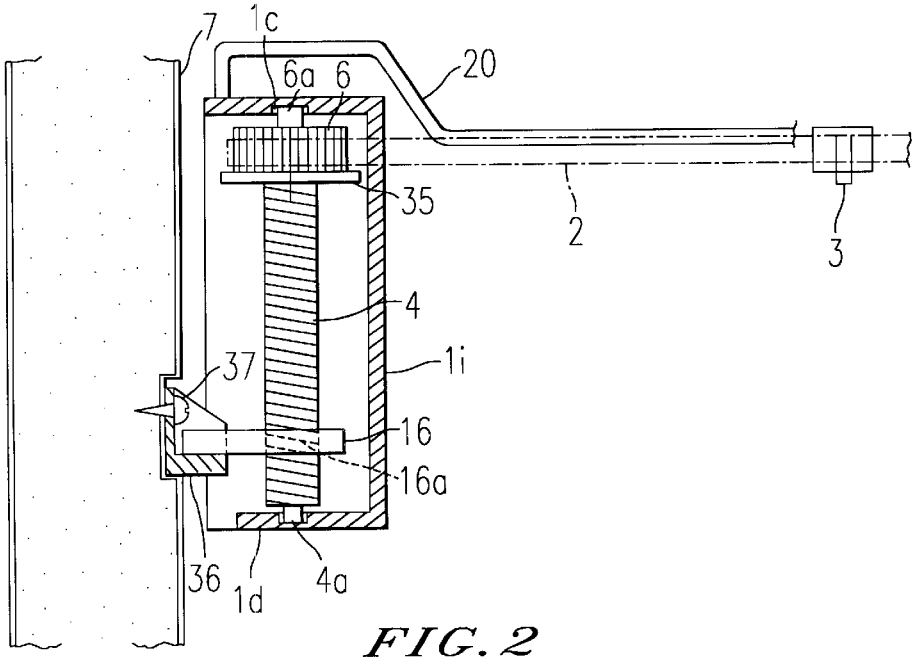
FIG. 2

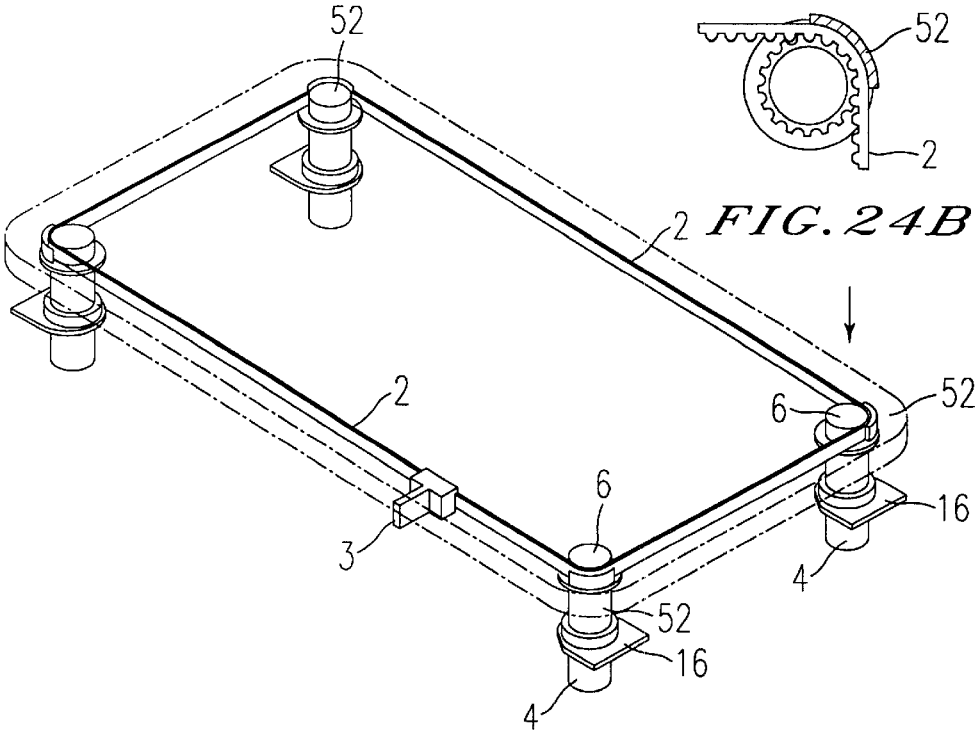
FIG. 24B
FIG. 24A
FIG. 25B
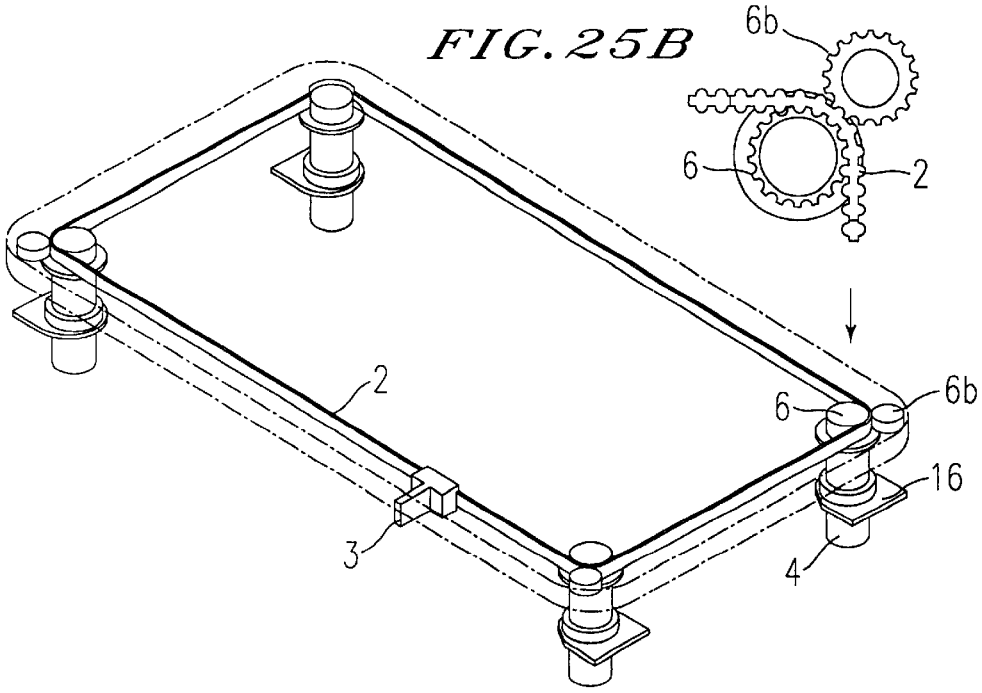
FIG. 25A

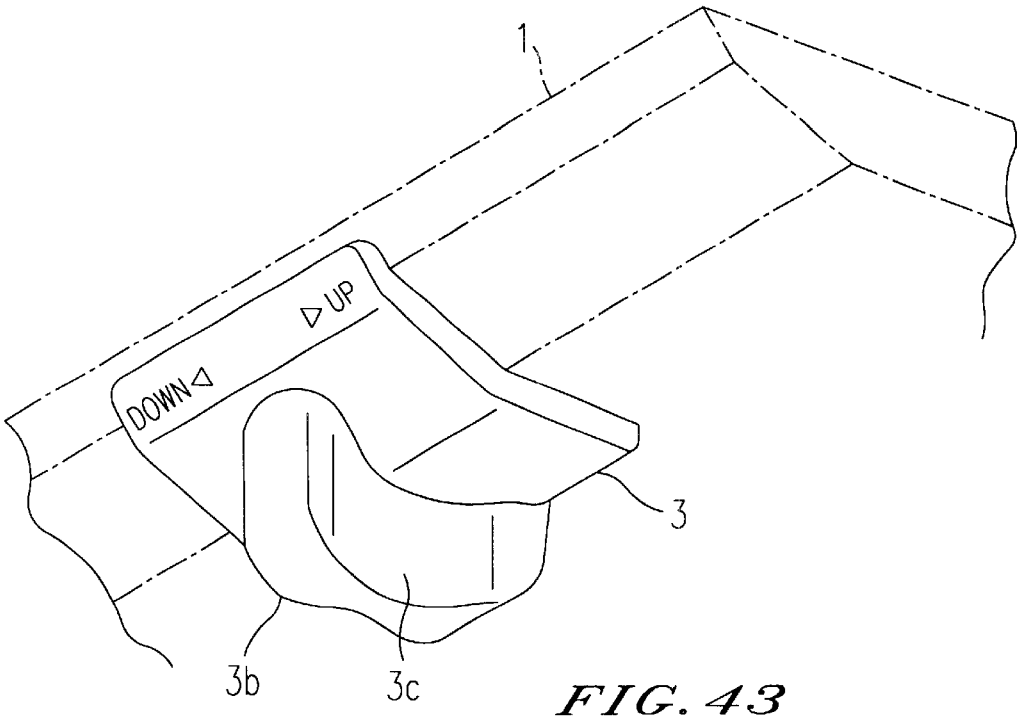
FIG. 43
FIG. 44
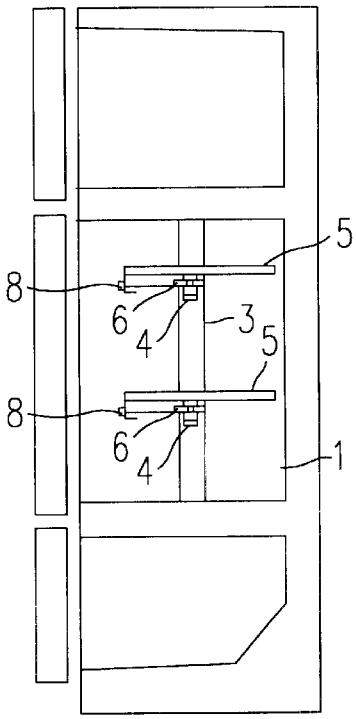

FIG. 45
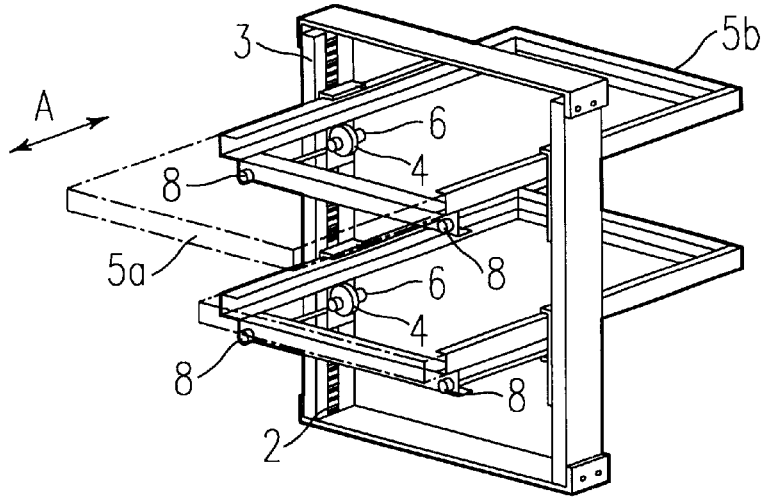
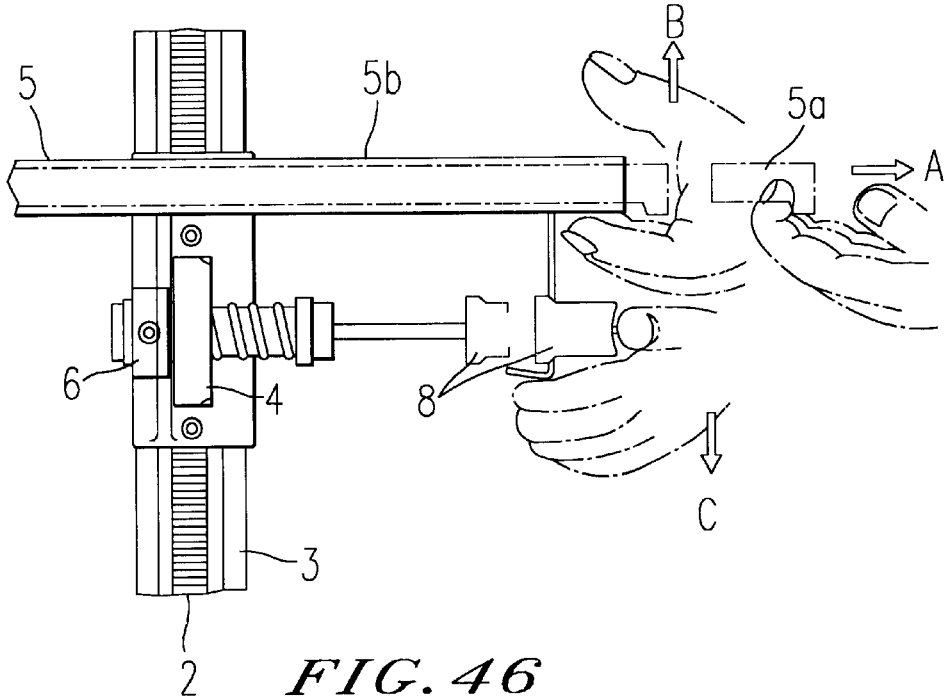
FIG. 46

REFRIGERATOR

BACKGROUND OF THE INVENTION

The present invention relates to a refrigerator having a shelf device which is provided inside the refrigerator and in which the height of a shelf can be adjusted to a free position.

Generally, regarding a refrigerator, there is a need of a shelf device in which a shelf can be up/down adjusted in accordance with sizes of foods and/or containers held in the refrigerator. Conventionally, for example, there is one as shown in Japanese Patent No. 2752300 as this type of shelf device inside a refrigerator.

FIG. 44 is a longitudinal section of a refrigerator having a conventional shelf device, FIG. 45 is a perspective view of the conventional shelf device, and FIG. 46 is a detail view of the conventional shelf device.

In the drawings, 1 is an inside of a refrigerator, 2 is a rack, 3 is a shelf support frame, 4 is a pinion gear, and 5 is a shelf main body having a shelf board 5*a* (chain line portion) and a shelf frame 5*b*. The shelf board 5*a* is slidable in the A direction in FIG. 45 relatively to the shelf frame 5*b*. Six (6) are gear shafts, 7 is a spring, and 8 is adjustment means.

At the refrigerator inside 1, there are provided the shelf support frame 3 having the rack 2, which constitutes a frame body of a longitudinal shape, the shelf main body 5 having, which aid of a support member, the pinion gear 4 meshing with the rack 2, the gear shaft 6 provided in the shelf main body 5 via a Z-shaped steel member to pivotally support the pinion gear 4, the spring 7 which is tightly wound around the outer peripheral face of the gear shaft 6 and whose one end is fixed on the pinion gear 4, and the adjustment means 8 set to compress the spring 7.

In a state where the pinion gear 4 of the shelf main body 5 is meshed with the rack 2 of the shelf support frame 3, the spring 7 is pulled in a direction to decrease its coil diameter by the self weight of the shelf main body 5 and firmly wound around the gear shaft 6, so that the pinion gear 4 is locked to fix the shelf main body 5 at a predetermined position. When the position of the shelf main body 5 is changed, the winding fixing force between the spring 7 and the gear shaft 6 is released by pressing the adjustment means 8 (chain line portion 8), whereby the shelf main body 5 can be freely adjusted in an up direction (B direction in FIG. 46) or a down direction (C direction in FIG. 46).

When the shelf main body 5 is adjusted only in the up direction (the B direction in FIG. 46), the shelf main body 5 is lifted up as it is in the up direction.

In the refrigerator having the conventional shelf device as described above, since the adjustment means 8 are provided in right and left two positions, they have to be operated by both hands at the same time to perform an up/down adjustment of the position of the shelf main body 5. Therefore, the operation to keep the body 5 becomes difficult and the operation with paying more attention is annoying, since either side of the adjustment means 8 is apt to move ahead.

Further, since the each adjustment means 8 supports the shelf main body 5 only at one position on each of left and right sides, a play in front-rear direction is apt to be generated due to unevenness of assembly, so that the shelf main body 5 is not stably fitted.

When the adjustment means 8 are operated to release the lock, there is a fear that the shelf main body 5 falls instantaneously at a stroke due to its self weight, so that there is a problem of insecurity.

Further, it is a difficult word to move the shelf main body 5 upward/downward while operating the adjustment means 8, considering the load amount of the shelf main body 5 on which food is placed.

When a conventional shelf device with a complex structure is provided, a part sometimes becomes rattled or floated, resulting in a poor operability.

There is a fear that a part is slipped off due to unevenness in sizes.

The resistance increases to the moving operation, thereby deteriorating the operability.

The design is not excellent.

The operability is poor.

Cool air is obstructed, so that cool air may not flow to the forward side if air volume is not enough, resulting in low cooling efficiency.

When the conventional shelf device with the complex structure is provided, a brake phenomenon is generated, and a smooth movement cannot be obtained.

A tooth skip of a belt (position mismatch between teeth of a gear and teeth of a belt) is apt to occur.

There is an occasion that the flow of cool wind is prevented depending on the way of putting a load, such as food on the shelf, so that uniform cooling is not necessarily achieved.

Since the knob shape of a lever is a simple square block shape, the touch in pinching the knob is uncomfortable, and it is difficult to concentrate one's force at the knob.

SUMMARY OF THE INVENTION

The present invention was developed in order to solve the problems described above and is to provide a refrigerator having a shelf device in which a position of a shelf can be reasonably adjusted as it is, by a small force and a single hand even if food is placed on the shelf, regardless of differences in the load amount of the food.

The present invention is to obtain a refrigerator having a high reliability and an excellent design and is further to provide a refrigerator of energy saving type in which the flow of the cool air inside the refrigerator is improved so as to improve the cooling efficiency.

The present invention is to provide a refrigerator in which a brake phenomenon due to a load, such as food, placed on a shelf is an extremely small so that the operation of the lever is improved, a trouble can be prevented at a time to lift up a shelf when the lever is most loaded in operation, the strength of a tray is increased, the entire room of the refrigerator is uniformly cooled down, and the lever can be easily pinched.

The refrigerator according to the first aspect of the present invention is provided with a shelf device comprising a frame for placing a shelf or the like on it, arranged inside the refrigerator, a timing belt provided inside the frame, a lever provided on the timing belt, and a means for moving the frame in an up/down direction in operative connection with the timing belt rotationally moved by moving the lever. Thus, the shelf can be moved up/down while keeping stored stuff, such as food on it, even by a small operating physical force.

The refrigerator according to the second aspect of the present invention is the one according to the first aspect in which a corner portion of the frame is extended to provide an extended portion, the means for moving the frame in the up/down direction is placed inside the extended portion, and a groove portion in which the extended portion is movably received is provided inside the refrigerator. Thus, a food storing space inside the refrigerator can be used effectively.

The refrigerator according to the third aspect of the present invention is the one according to the first aspect in which the shelf device is employed for a member for closing a ceiling part of a compartment provided inside the refrigerator. Due to this, the volume of the compartment is made variable so that it can be adjusted to a space chosen by a user.

The refrigerator according to the fourth aspect of the present invention is the one according to the first aspect in which the shelf device is employed for a bottom of a door pocket provided in a door of the refrigerator. Due to this, its height can be adjusted to a height chosen by a user, corresponding to stuff stored in the door pocket.

The refrigerator according to the fifth aspect of the present invention in the one according to the first aspect, further comprising an open/close door to close a front face of the refrigerator and a partition wall to partition the inside of the refrigerator plurally, wherein the partition wall is movable in the up/down direction. Thus, the refrigerator can flexibly deal with various stored stuff in accordance with the size thereof.

The refrigerator according to the sixth aspect of the present invention is the one according to the first aspect in which the frame is provided with a cool air intake for taking cool air in from a cool air supply duct provided between an inner case and an outer case of the refrigerator and a cool air outlet for sending out the cool air to the inside of the refrigerator. Thus, a uniform temperature distribution inside the refrigerator can be obtained by a simple work to provide holes in the frame.

The refrigerator according to the seventh aspect of the present invention is the one according to the first aspect, in which the shelf device further comprises a holding means and a fixing means; the frame is provided with a screw shape shaft pivotally supported in an up/down direction; the moving means is provided with a meshing portion for meshing with the screw shape shaft, and a flange portion having a locking portion at one end thereof; the holding means is provided with an engaging portion for engaging with the locking portion at the time when the moving means is placed on the holding means from the above, and an insert piece extending from a placing face when the moving means is placed; and the fixing means is provided with a pinching portion to insert and fix the insert piece and an abutting portion arranged on an open side of the pinching portion to stop the locking portion of the moving means abutting against the abutting portion; and the fixing means is fixed to an inner wall of the refrigerator so that the moving means is fixedly held on the inner wall with aid of the holding means to make the frame movable in the up/down direction. Thus, at the time of a manual operation of the lever, the frame connected to the moving means hardly has horizontal play, thereby improving the operability. Further, the holding means is integrally engaged with the moving means and a margin to insert in the fixing means can be fully secured.

The refrigerator according to the eighth aspect of the present invention is the one according to the seventh aspect in which the locking portion of the moving means extends in an axial direction of the screw shape shaft from the flange portion in an axial direction, and the engaging portion of the holding means is arranged approximately perpendicularly to the placing face. Thus, even if food is unevenly placed on the shelf, the moving means is not lifted away from the holding means at the time of a lever operation, thereby producing an advantageous effect that the operability is improved.

The refrigerator according to the ninth aspect of the present invention is the one according to the seventh aspect in which the insert piece of the holding means is arranged approximately horizontally or in a diagonal direction to the placing face, and the pinching portion side of the fixing means is embedded in the inner wall of the refrigerator. Due to this, the space inside the refrigerator can be effectively utilized.

The refrigerator according to the tenth aspect of the present invention is the one according to the seventh aspect in which a protrusion or a hole portion is provided in the flange portion of the moving means and a hole portion or a protrusion is provided in the holding means to engage with the protrusion or hole portion of the moving means. Due to this, there is no case in which when the lever is slid the moving means is shifted beyond the holding means in the sliding direction to bring the frame into contact with the inner side wall of the refrigerator, so that the operability of the lever and the convenience to move the shelf become excellent.

The refrigerator according to the eleventh aspect of the present invention is the one according to the seventh aspect in which a force of a sliding movement of the lever provided on the timing belt is transmitted via the timing belt to a gear which is fixedly and coaxially provided at one end of the screw shape shaft and engaged with the timing belt, so that the screw shape shaft is rotated. That makes the refrigerator compact.

The refrigerator according to the twelfth aspect of the present invention is the one according to the eleventh aspect in which the timing belt is arranged in an inside peripheral part of the frame, and the screw shape shafts engaged with the timing belt to rotate are provided in at least two corners of the frame. Due to this, the timing belt can rotationally move more stably.

The refrigerator according to the thirteenth aspect of the present invention is the one according to the seventh aspect in which a screw pitch of the screw shape shaft is set at 9 mm or less, and a lead angle of the screw shape shaft is set for 15° degree or less. Thus, considering a food weight loaded on a shelf of a size employed in a general household refrigerator, the operating physical force is appropriately reduced, in manual operation of the lever by a user.

The refrigerator according to the fourteenth aspect of the present invention is the one according to the seventh aspect in which a protrusion is provided on an outer wall of the meshing portion of the moving means, and a groove is provided in the frame correspondingly to the protrusion, on an inner wall of a housing portion for the screw shape shaft, so that the groove guides the protrusion as a track. Thus, rotation of the moving means can be prevented regardless of the shape of the frame, so that a refrigerator with an excellent design can be provided.

The refrigerator according to the fifteenth aspect of the present invention is the one according to the first aspect further comprising a connecting duct which is provided in the frame so as to be disposed near an outlet of a cool air supply duct provided between an inner wall and an outer wall of the refrigerator, to conduct cool air formed from the outlet of the cool air supply duct to the front inside of the frame. Thus, cool air can flow to the front with a small air volume resulting in improved cooling efficiency and energy saving.

The refrigerator according to the sixteenth aspect of the present invention is the one according to the first aspect in which the shelf device further comprises a timing belt coupling means consisting of a socket and a slider portion which is slidable to the socket and loaded with a spring toward the socket, and the lever and one end of the timing belt are connected to the socket and the other end of the timing belt is connected to the slider portion so that the frame is moved up and down conjointly with sliding of the lever via timing belt rotationally moved. Thus, slack of the belt is prevented, so that a refrigerator with a high reliability can be obtained.

The refrigerator according to the seventeenth aspect of the present invention is the one according to the sixteenth aspect in which the lever is provided with an insert piece formed by extending a root of the lever, and the insert piece is inserted into a slit portion provided in a front part lower face of the frame and is engaged with the socket of the timing belt coupling means for connecting the timing belt so that the lever and the timing belt are connected to each other. Thus, the timing belt does not show from the slit of the frame when the frame is seen from the front of the refrigerator, so that a refrigerator with an excellent design can be obtained.

The refrigerator according to the eighteenth aspect of the present invention is the one according to the sixteenth aspect in which a frame reinforcing plate is arranged along a track of the lever moving along the frame. Thus, even when a food weight is excessively loaded, flexure of the frame can be minimized, so that a rectilinear motion in the lever operation can be secured with an excellent operability.

The refrigerator according to the nineteenth aspect of the present invention is the one according to the sixteenth aspect, having the shelf device in which a front part of the frame is a metal frame, and the timing belt is arranged inside the metal frame. Due to this, deformation of the frame due to a food weight load is small, and the operability of the lever can be maintained excellently.

The refrigerator according to the twentieth aspect of the present invention is the one according to the first aspect in which the shelf device comprises a removable shelf placed on the frame, and the removable shelf is provided with a lower front part having a U-shaped rib opening forward so as to be engaged with a flange portion formed at a front side inner edge of the frame, and a L-shaped rear part so as to cover a rear part of the frame. Thus, the shelf and the frame can be integrally engaged as one body, whereby the strength of the entire shelf can be improved.

The refrigerator according to the twenty-first aspect of the present invention is the one according to the eleventh aspect in which the gear fixedly provided in the screw shape shaft is provided with a plurality of rotatable balls which are embedded inside the gear and an upper supporting shaft, which is rotatably engaged with the gear with intervention of the rotatable balls, the frame is provided with a bearing portion having a hole, and the upper supporting shaft is set to the bearing of the frame with its upper end inserted in the hole, so that the gear can rotate. Due to this, the operation of the lever becomes smooth.

The refrigerator according to the twenty-second aspect of the present invention is the one according to the twenty-first aspect in which the upper face of the balls is protruded from the upper face of the gear, and the gear rotates while the lower face of the bearing hole of the frame gets in contact with the balls. Thus, even when the upper face portion of the gear is pressed by the load, such as food, placed on the shelf, a brake phenomenon against to the rotation of the gear is extremely small, whereby the operating physical force of the lever is improved.

The refrigerator according to the twenty-third aspect of the present invention is the one according to the sixteenth aspect in which the timing belt is attached to the timing belt coupling means in such a manner that in a case where the lever is slid in the right direction in its operation to lift up the shelf, one end of the timing belt is fixed to the socket of the timing belt coupling means on the left side while the other end of the timing belt is connected to the slider portion of the timing belt coupling means on the right side, and in a case where the lever is slid in the left direction in its operation to lift up the shelf, one end of the timing belt is fixed to the socket the timing belt coupling means on the right side while the other end of the timing belt is connected to the slider portion of the timing belt coupling means on the left side. Thus, since the slack of the timing belt can be absorbed by the resiliency of the spring in the lifting-up process where the lever is most loaded in operation, so that a tooth skip of the belt (position mismatch between teeth of the gear and teeth of the belt) can be prevented.

The refrigerator according to the twenty-fourth aspect of the present invention is the one according to the first aspect in which the shelf provided on the frame for placing the shelf on it is made of a resin, and a metal member is placed on the upper face of the shelf. Due to this, the strength of the shelf can be increased.

The refrigerator according to the twenty-fifth aspect of the present invention is the one according to the first aspect in which the shelf provided on the frame for placing the shelf on it is made of a metal. Due to this, the strength of the shelf can be increased.

The refrigerator according to the twenty-sixth aspect of the present invention is the one according to the twenty-fourth or twenty-fifth aspect in which part of cool air led to the inside of the frame for placing the shelf blows against a metal member or the metal shelf provided on the frame. Due to this, the entire shelf is uniformly cooled down so that the temperature distribution is improved. Further, the space between shelves is also cooled down uniformly, so that the distribution of the entire room is improved.

The refrigerator according to the twenty-seventh aspect of the present invention is the one according to the first aspect in which a knob shape of the lever is formed into a recess dented toward the inner side, corresponding to an abdominal portion of a finger. Due to this, the lever can be easily pinched so that force can be applied.

BRIEF DESCRIPTION OF THE DRAWINGS

FIG. 1 is a perspective view of a shelf device according to the first embodiment of the present invention.

FIG. 2 is a sectional view of the shelf device according to the first embodiment of the present invention.

FIG. 24 is a perspective view of a screw shape shaft part and the vicinity thereof according to the second embodiment of the present invention.

FIG. 25 is a perspective view of a screw shape shaft part and the vicinity thereof according to the second embodiment of the present invention.

FIG. 43 is a perspective view showing a knob shape of the lever according to the third embodiment of the present invention.

FIG. 44 is a side view of a refrigerator having a conventional shelf device.

FIG. 45 is a perspective view of the conventional shelf device.

FIG. 46 is a side view of the conventional shelf device.

BEST MODE FOR CARRYING OUT THE INVENTION

First Embodiment

One embodiment of the present invention will be explained below referring to drawings.

Figure 3:
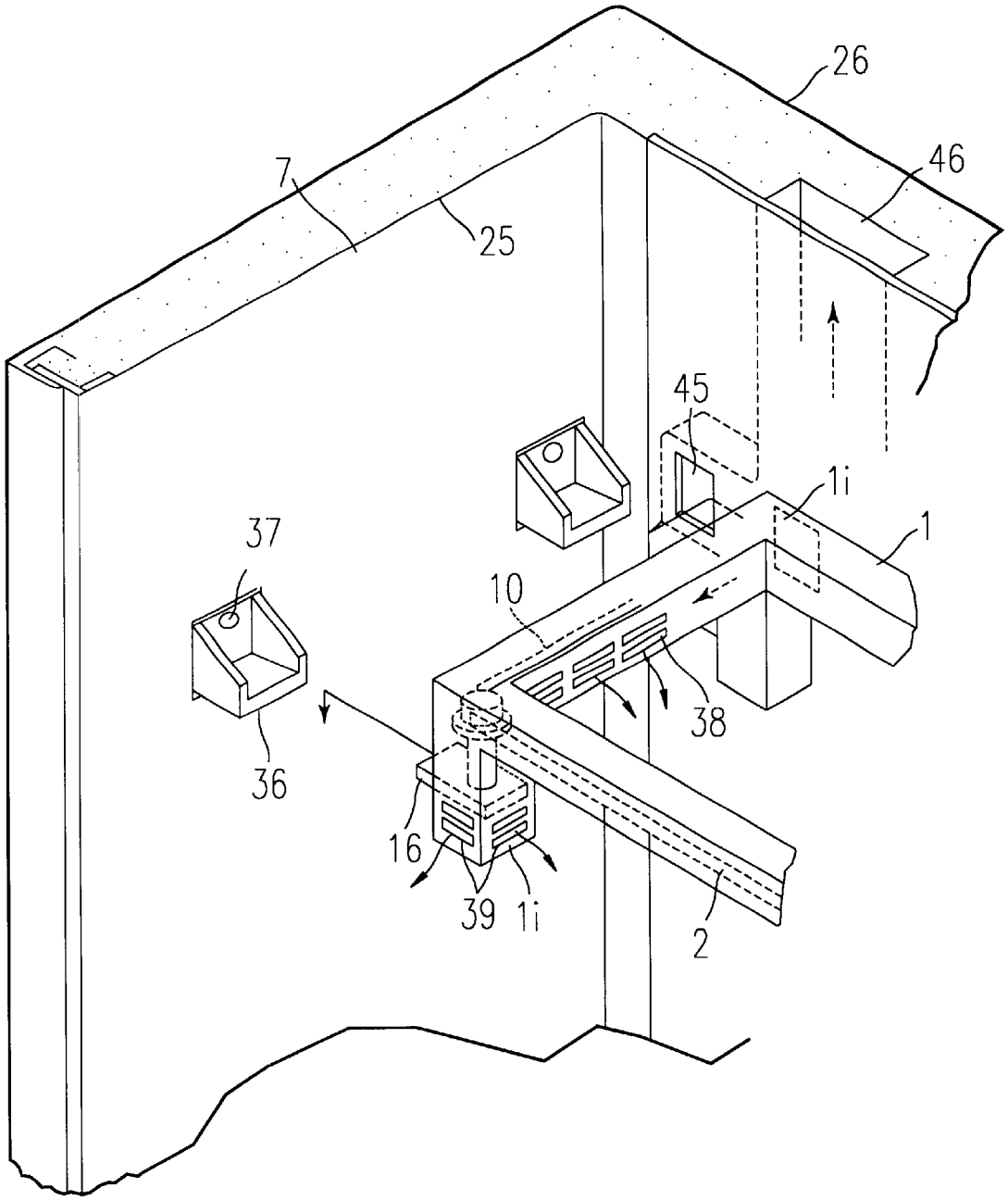
FIG. 3 is an installation view of the shelf device according to the first embodiment of the present invention.

FIG. 1 is a perspective view of a shelf device, FIG. 2 is a main part section of the shelf device, and FIG. 3 is a installation view of the shelf device in a refrigerator. In the drawings, 1 is a frame for placing a shelf on it, 1*c*, 1*d* are bearing portions provided in a leg portion 1*i*, 1*i* is a leg portion of the shelf placing frame 1, 1*j* is a cool air intake provided in the shelf placing frame 1, 2 is a timing belt, 2*a* is a rack shape portion of the timing belt 2, 3 is a lever, 4 is a screw shape shaft, 4*a* is a small shaft portion of the screw shape shaft 4, 6 is a gear, 6*a* is a small shaft portion of the gear 6, 7 is a side wall (side face part of an inner board 25) of a refrigerator inside 50, 10 is a hollow part of the frame 1, 16 is a moving board, 20 is a shelf removably placed on the frame 1, 25 is an inner board of the a refrigerator, 26 is an outer board of the refrigerator, 35 is a flat seat, 36 is a shelf receiving portion, 37 is a screw, 38, 39 are air outlets provided in the frame 1, 45 is a vent hole provided in the rear face of the refrigerator, and 46 is a cool air supply duct.

The frame 1 is a frame for placing a shelf on it, constituted by a hollow shaped frame having a hollow part 10. The timing belt 2 arranged along the outer periphery of the frame is mounted in the frame utilizing the hollow part 10. The lever 3 is fixedly connected with the timing belt 2 by means of a screw 43 and is arranged so as to move along one side of the shelf placing frame 1. Consequently, the timing belt 2 is rotationally moved by sliding the lever 3. The gears 6 meshing with the rack shape portion 2*a* of the timing belt 2 to be rotated are arranged on the rotationally moving line of the timing belt 2 and in the respective corners of the shelf placing frame 1. A screw shape shaft 4 is integrally formed with the gear 6 coaxially, with intervention of the flat seat 35 having a larger diameter than that of the gear 6. Although the flat seat 35 prevents shift of the timing belt 2, the flat seat 35 is not always necessary.

The screw shape shaft 4 rotates according to the rotation of the gear 6 by means of the timing belt 2. Sixteen (16) is the moving board having a screw tapped hole 16*a* in which the screw shape shaft 4 is screwed so that the moving board moves upward/downward due to feeding by the screw at the time when the screw shape shaft 4 rotates. The leg portions 1*i* are formed in the each corner (four portions) of the shelf placing frame 1. The small shaft portions 6*a*, 4*a* coaxially protruding from the gear 6 and the screw shape shaft 4 are pivotally supported on the bearing portions 1*c*, 1*d* of the leg portion 1*i* so that a screw shape shaft part is housed in the leg portion 1*i*. Here, the number of parts can be reduced by integrally forming the gear 6 and the shaft 4. Although it is explained here that the leg portions 1*i* are provided in the four corners, they may be provided in two corners so as to be opposed to each other in the left/right direction, thereby generating stability. In the case where there is no corner in the shelf placing frame 1, for example, as in the case where the shelf placing frame 1 has a circle shape, the leg portions 1*i* may be provided at opposite positions to each other, such as the right and the left or the forward and the rearward.

Next, the case where the shelf device is installed in a refrigerator inside 50 will be shown.

Thirty-six (36) is the shelf receiving portion fixed at a predetermined position of the side wall 7 of the refrigerator inside 50 by means of the screw 37, and is arranged so that the moving board 16 in which the screw shape shaft 4 in the frame is screwed is placed oppositely. The moving board 16 set in the shelf placing frame 1 is fixed by a self weight when being placed on the shelf receiving portion 36, so that the frame 1 itself, not the board 16, actually moves up and down.

That is, by sliding the lever 3, the timing belt 2, the gear 6, the screw shape shaft 4, and the moving board 16 move in response thereto, and the shelf placing frame 1 moves up/down by fixing the moving board 16 on the side wall 7 inside the refrigerator.

In the above, although the shelf 20 is removably placed on the shelf placing frame 1, the shelf placing frame 1 and the shelf 20 may be fixed to be made one body, or the shelf placing frame 1 and the shelf 20 may be integrally molded from the beginning as a shelf device having a structure of a shelf 20 having the shelf placing frame 1 in its lower part.

Although the one in which the shelf device is employed in a refrigerator is shown in the present embodiment, the shelf device can be applied to all various types of storing implements, such as a small showcase, a business showcase, a piece of furniture, or the like.

In FIG. 3, cool air is guided through the cool air supply duct 46 provided in the rear part of the refrigerator and between the inner board 25 and the outer board 26. Utilizing the hollow part 10 of the shelf placing frame 1, air courses are so formed that part of the cool air is taken from the air hole 45 of the duct into the cool air intake 1*j* of the shelf placing frame 1 to guide the cool air to the air outlet 38 provided in a side face of the shelf placing frame 1 and the air outlet 39 provided in a front face and a side face of the leg portion 1*i* of the shelf placing frame 1. The air hole 45 and the cool air intake 1*j* are formed so as to be opposed to each other when the moving board 16 is placed on the shelf receiving portion 36. Here, although a structure in which the cool air supply duct 46 is provided in the rear part of the refrigerator is shown, the cool air intake 1*j* may be provided in a side face of the shelf placing frame 1 in the case where the duct 46 is provided in a side part.

With the above, since the shelf device is constructed so that cool air blows out even to the front portion inside the refrigerator, a temperature distribution inside the refrigerator can be uniformed.

Further, cool air can be supplied to desired parts through a simple work to provide holes such as the air outlets 38, 39 at necessary portions of the shelf placing flame 1.

While stored stuff, such as food, is placed on the shelf, the shelf can be moved up/down only by horizontally sliding the lever along the front face of the shelf placing frame, so that operation can be executed only by one hand. Since the whole width of the shelf can be fully used as a lever operation range, the screw shape shaft can be rotated to a considerable extent, so that the shelf can be moved up/down even by a small operating physical force.

Since the shelf placing frame moves up/down by the movement of the moving board engaged with the screw shape shaft, the shelf does not move only by weighing a load on the shelf. Therefore, it is possible to provide a shelf device, in which a lock release mechanism is unnecessary, having excellent operability and safety, and constituting of a smaller number of parts. However, a lock mechanism may be provided in the lever part so as to improve the safety at the time the shelf is heavily loaded.

The room volume can be changed by partitioning the room with a variable partition wall.

Figure 4:
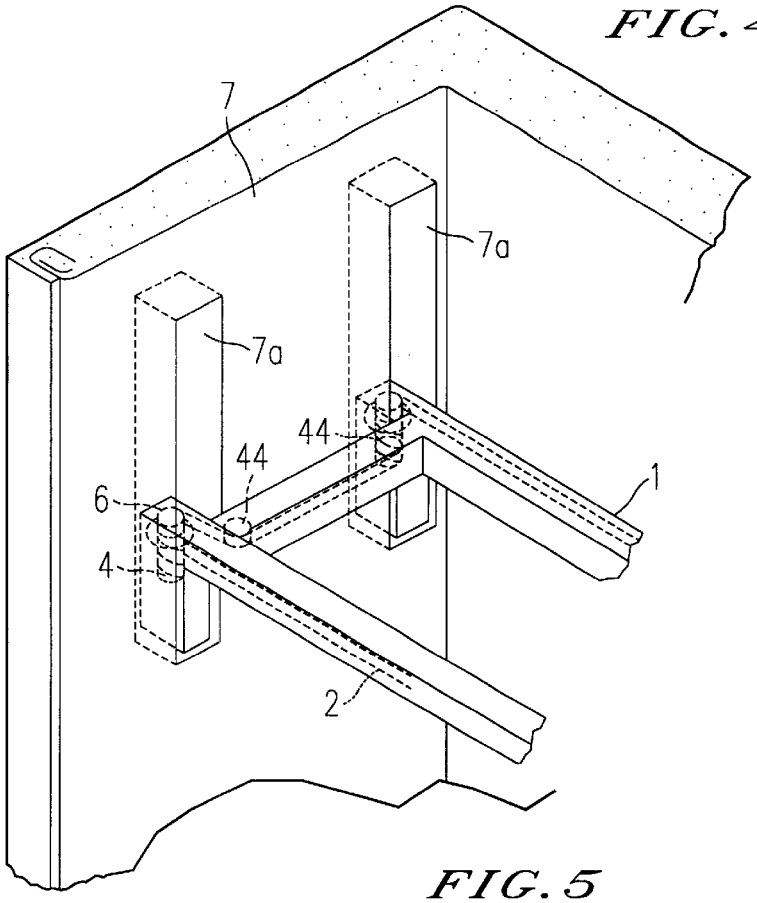
FIG. 4 is a perspective view of the shelf device according to the first embodiment of the present invention.

The food storing space inside the refrigerator can be used effectively by making the position of the gear 6 and the screw shape shaft 4 extend from the corner part of the shelf placing frame 1 and arranging it along a groove part 7*a* provided in the side wall 7 of the refrigerator so as to arrange the timing belt 2 to engage with the gear 6 via a rotatable roller 44 as shown in FIG. 4.

An example in which the structure of the shelf device shown in the above embodiment is employed for a ceiling wall of a partitioned space for special use will be shown.

Figure 5:
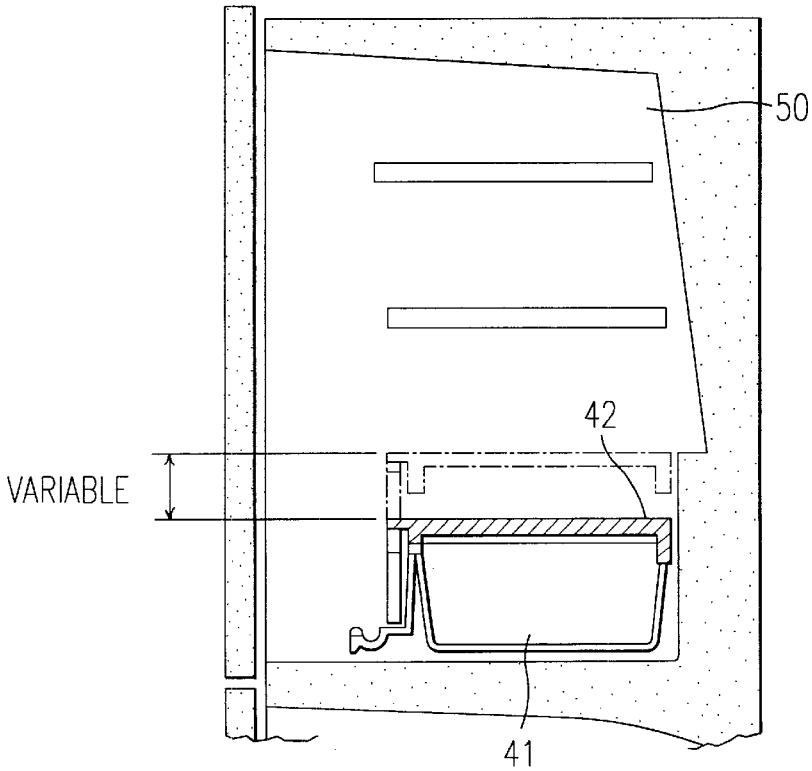
FIG. 5 is a sectional view of an exclusive temperature range compartment part according to the first embodiment of the present invention.

As shown in FIG. 5, for example, a ceiling wall 42 which holds an open/close door for a partitioned space for special use, such as a chilled compartment or a new freezing temperature range compartment 41 having a special temperature range for the special use, in the inside of the refrigerator, is moved with a lever or the like (not shown) by providing the timing belt (not shown), the screw shape shaft (not shown), and the moving board (not shown), so that the volume of the partitioned space (the chilled compartment or the freezing temperature range compartment 41) can be changed to adjust the space as a user wants. In the drawing, the partitioned space can be maintained within a special temperature range, by securing a lapping distance of the open/close door over a case more than the moving range of the ceiling wall.

Such a volume adjustment can be performed not only by means of a horizontal partition wall to partition a room into an upper and a lower portions as the ceiling partition wall 42 but also by means of a longitudinal partition wall which is movable in a right/left direction, so that the present shelf device is the most effective means, for example, for a chilled compartment or a new freezing temperature range compartment in a cold room. Further, although the volume adjustment can be performed, of course, according to preference of a consumer user, products having different volumes of the partitioned space for special use can be also manufactured in one model, so that the present embodiment leads to an improved productivity from point of view of factory production.

An example in which the structure of the shelf device shown in the above embodiment is employed for a door pocket provided in a refrigerator door will be shown.

Figure 6:
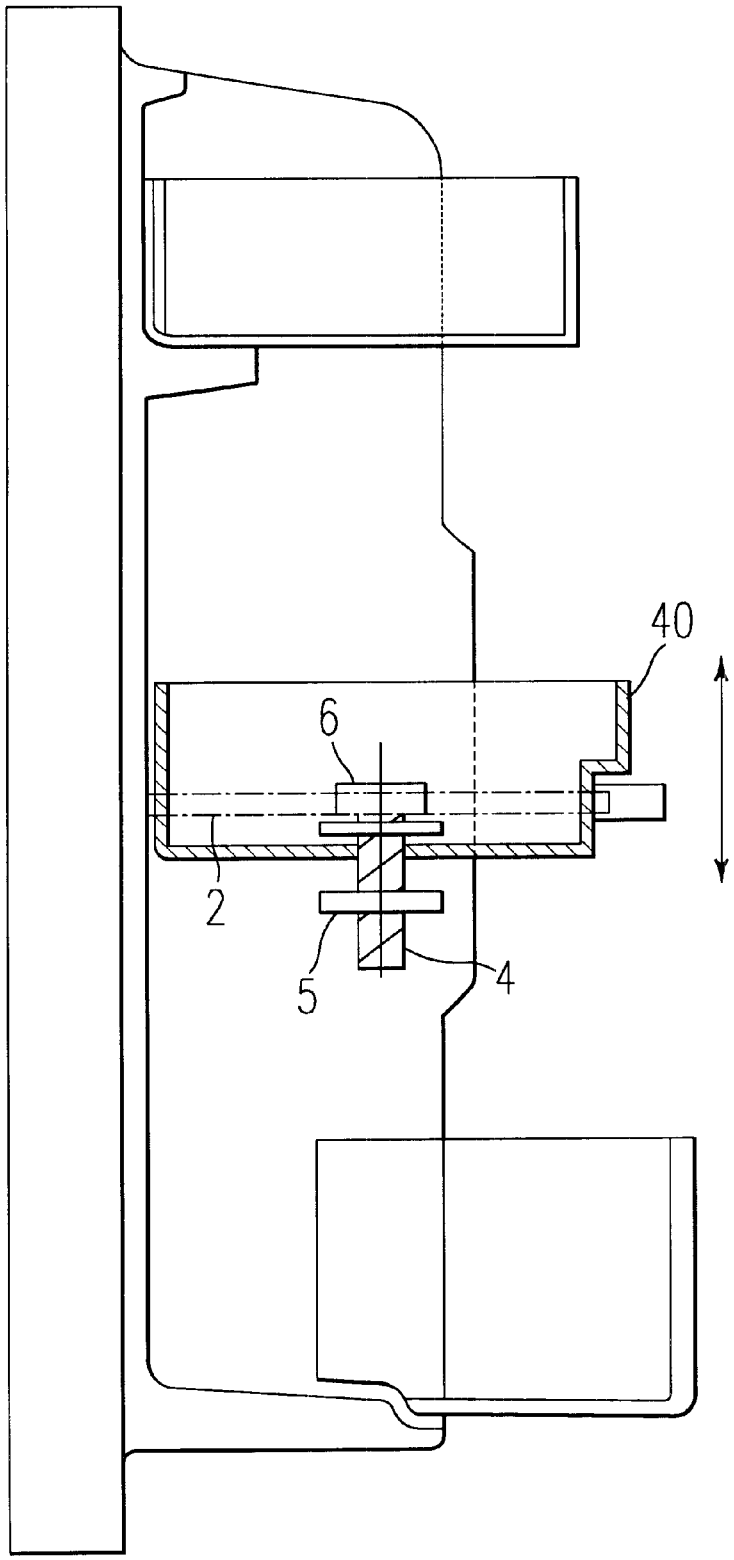
FIG. 6 is a sectional view of a door pocket part according to the first embodiment of the present invention.

As shown in FIG. 6, a position of the door pocket 40 can be changed up and down by moving the door pocket equipped with the timing belt 2, the screw shape shaft 4, and the moving board 5, so as adjust the door pocket to a height preferred by a user, corresponding to types of a bottle, a PET bottle, or the like to be stored.

As described above, the present shelf device can be applied in order not only to adjust the height of a shelf but also to move of a wall of a partitioned storing space, a door pocket, or the like, so that a product can be provided in which a shelf height/width can be flexibly changed corresponding to sizes of various containers, such as a dish, a pan, a bottle, a PET bottle, or the like, according to differences in family constitution and eating habit. The shelf device of the present invention can be applied to all other various types of storing implements than a refrigerator, such as a small showcase, a business showcase, a piece of furniture, or the like.

Second Embodiment

One embodiment of the present invention will be explained below referring to drawings.

Figure 7:
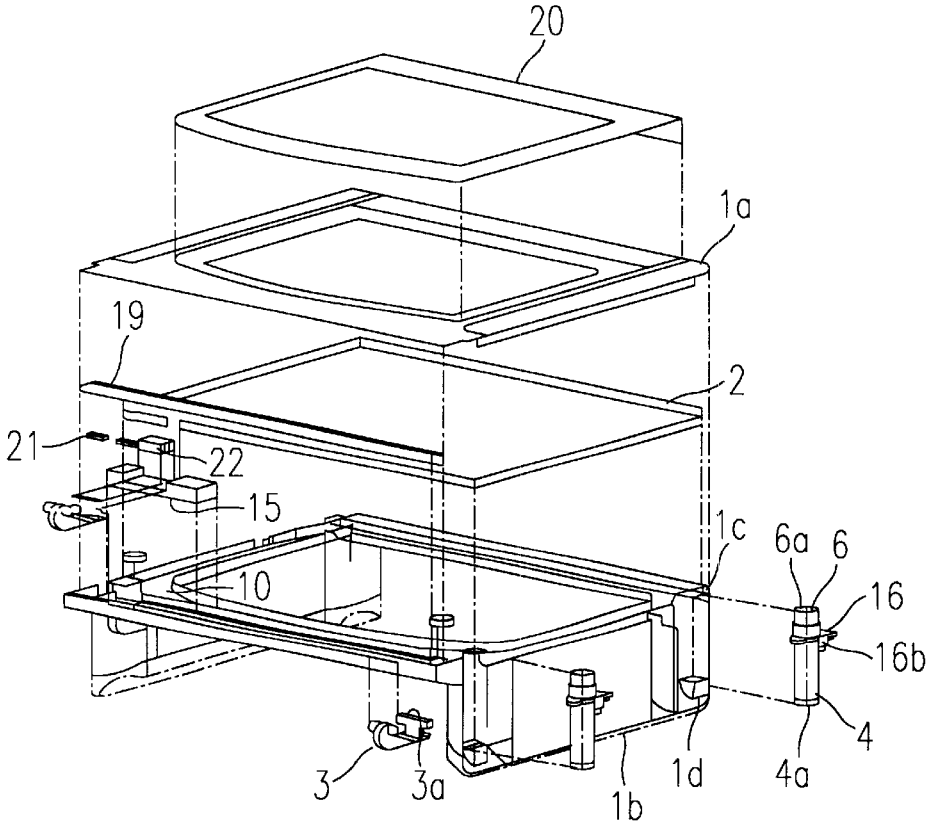
FIG. 7 is an assembly perspective view of a shelf device according to the second embodiment of the present invention.
Figure 8:
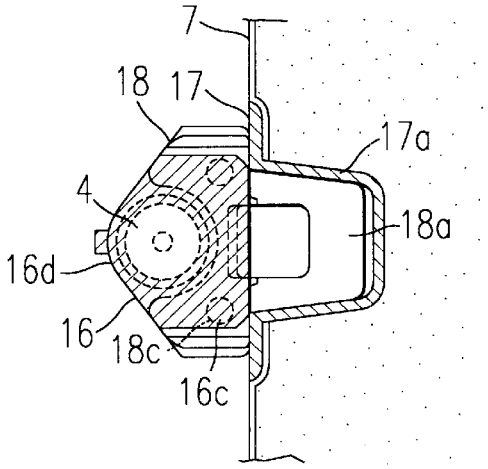
FIG. 8 is a detailed plan view of a moving leg and a holding member according to the second embodiment of the present invention.
Figure 9:
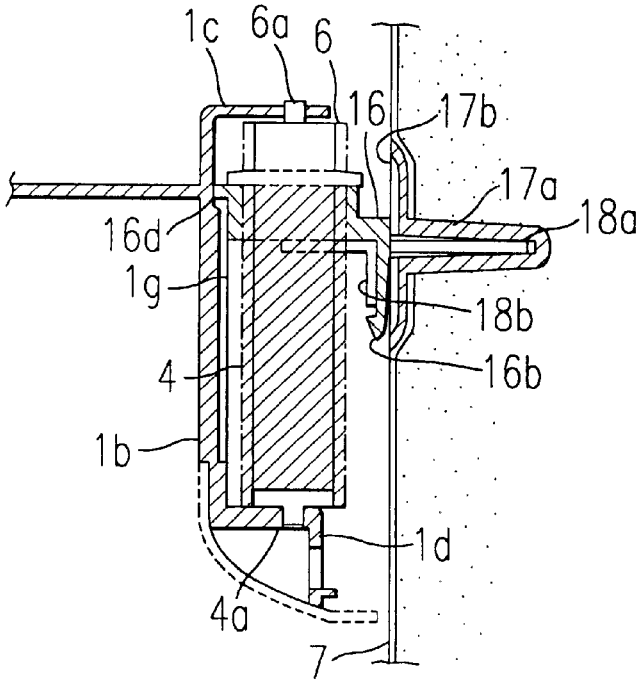
FIG. 9 is a detailed section of the moving leg and the holding member according to the second embodiment of the present invention.
Figure 10:
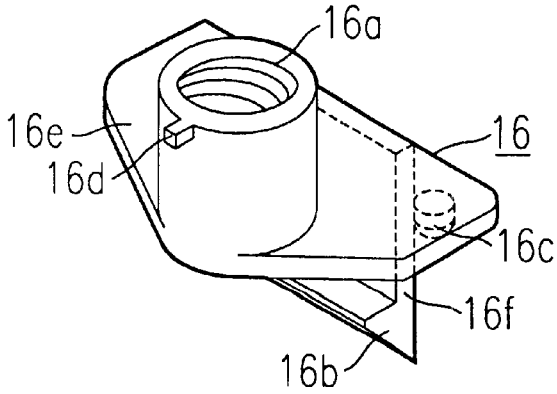
FIG. 10 is a perspective view of the moving leg according to the second embodiment of the present invention.
Figure 11:
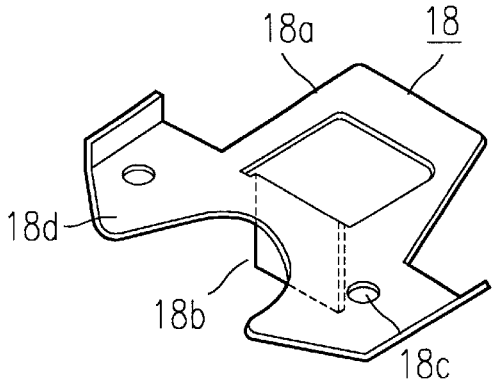
FIG. 11 is a perspective view of the holding member according to the second embodiment of the present invention.
Figure 12:
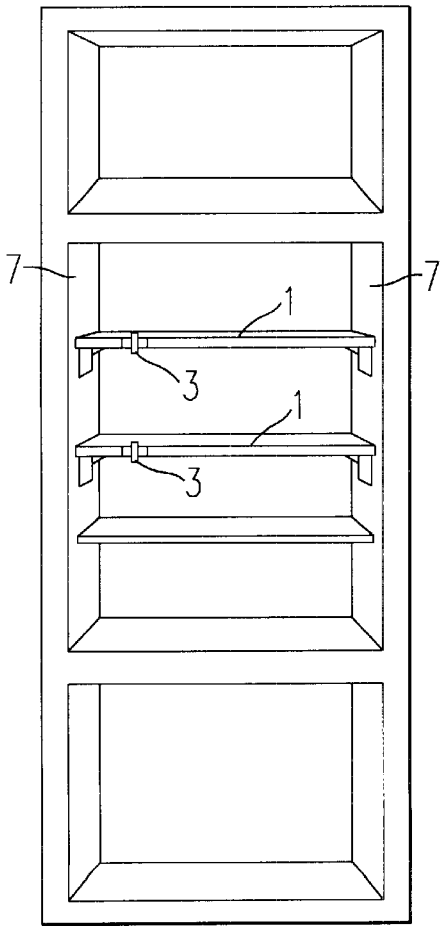
FIG. 12 is an elevational perspective view of a refrigerator according to the second embodiment of the present invention.

FIG. 7 is an assembly perspective view of a shelf device of the present invention, FIG. 8 is a detailed plan view of a moving leg and a holding member, FIG. 9 is a detailed longitudinal section of the moving leg and the holding member, FIG. 10 is a perspective view of the moving leg, FIG. 11 is a perspective view of the holding member, and FIG. 12 is an elevational perspective view of a refrigerator. In the drawings, 2 is a timing belt, 3 is a lever, 4 is a screw shape shaft with which a gear 6 is integrally formed coaxially, 7 is an inner wall of a refrigerator inside, 15 is a timing belt coupling socket, 16 is the moving leg as a moving means, 17 is an attachment as a fixing means, 18 is a holding member as a holding means, 19 is a frame reinforcing plate, 20 is a removable shelf, and 22 is a slider portion having a spring 21.

A frame 1 for placing a shelf on it, constituted by a hollow shaped frame is formed by the combination of an upper side frame 1*a* and a lower side frame 1*b*, and a hollow part 10 is formed in the frame. The timing belt 2 arranged along the outer periphery of the frame is mounted in the frame utilizing the hollow part 10. The lever 3 is arranged so as to move along one side of the frame 1, and an insert piece 3*a* extending from the root of the lever 3 is inserted from a slit portion provided in a front lower face of the shelf placing frame 1 into the inside of the shelf placing frame 1 and is fitted into the timing belt installing socket 15 so as to be coupled with and fixed to the timing belt 2, whereby the timing belt 2 is rotationally moved by sliding the lever 3. The gears 6 meshing with a rack shape portion (not shown) of the timing belt 2 to be rotated are arranged on the rotationally moving line of the timing belt 2 and in the respective corners of the frame 1, and a screw shape shaft 4 is integrally formed with the gear 6 coaxially. A small shaft 6*a* and a small shaft 4*a* coaxially protruding from the gear 6 and the screw shape shaft 4 respectively are pivotally supported in a longitudinal up/down direction on bearings 1*c*, 1*d* each provided in the frame 1 so that the screw shape shaft 4 is housed in the respective corners (four portions) of the frame 1. The timing belt 2 meshes with the gear to rotate the gear 6 so that the screw shape shaft 4 rotates sequentially. Although it is explained here that the screw shape shafts 4 are provided in the four corners, they may be provided in two corners so as to be opposed to each other in the left/right direction, thereby generating stability. The moving leg 16 has a screw tapped hole 16*a* of a meshing part as a female screw corresponding to the screw shape shaft 4, and the screw shape shaft 4 is screwed into this screw tapped hole 16*a*, so that the moving leg 16 is moved up and down by the screw in accordance with the rotation of the screw shape shaft 4.

Seventeen (17) is a fixing means having a pinching portion 17*a* to be placed at a predetermined position of an inner wall 7 of the refrigerator and is provided with a dish portion 17*b* at a mouth of the pinching portion 17*a*. The pinching portion is embedded in the inner wall, and the attachment 17 is fixed so that the dish portion becomes flush with the wall face. In the drawing, although a U-shaped groove is employed as the pinching portion, a clamp or the like may be employed as far as it has the same function. As shown in FIG. 11, the holding member 18 has a placing face 18*d* on which the moving leg 16 is placed from the above and an insert piece 18*a* in the shape of a flat plate extending horizontally from the placing face. That insert piece is inserted in the U-shaped groove 17*a* of the attachment so that the holding member 18 is fixed to the inner wall via the attachment 17. The holding member 18 is provided with an engaging portion 18*b* approximately vertically opened from the placing face, so that this engaging portion 18*b* is placed in parallel with the inner wall when the holding member 18 is inserted into the attachment 17.

As shown in FIG. 10, the moving leg 16 described above has a flange portion 16*e* in a lower end of the screw tapped hole 16*a* in which the screw shape shaft 4 is screwed, a protruding piece portion 16*f* bent in the axial direction of the hole is formed in one end of that flange portion 16*e*, and a locking portion 16*b* is provided at the tip of the protruding piece portion 16*f*. When this moving leg 16 is placed on the holding member 18, the protruding piece portion 16*f* of the moving leg is inserted along the engaging portion 18*b* of the holding member, and the locking portion 16*b* at the tip of the protruding piece portion is hooked on the engaging portion 18*b* of the holding member so that the protruding piece portion is held on the engaging portion and is pinched between the engaging portion and the dish portion 17*b* of the attachment to be fixed. Thereby, the moving leg 16 is engaged with the holding member 18, so that rattling or floating of the frame 1 can be prevented. Here, the locking portion 16*f* is formed into a claw shape, a hook shape, or the like. Further, even when a load from the frame is weighed on the moving leg and a downward moment works, the protruding piece portion of the moving leg is pressed by the dish portion of the attachment, whereby flexure can be prevented. Since the attachment 17 is embedded inside the inner wall so as to minimize an obstructive part to the surface and the space inside the refrigerator, the space inside the refrigerator can be effectively utilized.

Since the moving leg 16 is set on the side of the frame 1 via the screw shape shaft 4 and is fixedly placed on the holding member 18 as described above, the frame 1 itself, not the moving leg 16, is actually moved up and down. That is, the lever 3 is slid so that the timing belt 2, the gear 6, the screw shape shaft 4, and the moving leg 16 are conjointly moved, and the moving leg 16 is fixed to the attachment 17 installed in the inner wall 7 so that the shelf placing frame 1 moves up and down. Sliding between the holding member 18 and the moving leg 16 in the horizontal direction can be prevented by providing the placing face 18*d* of the holding member 18 and the flange portion 16*e* of the moving leg 16, respectively, which come in contact with each other with, for example, a hole portion 18*c* and a protrusion 16*c* respectively, so that the hole portion and the protrusion are engaged with each other when the moving leg 16 is placed on the holding member 18. Owing to this, when the lever 3 is slid, the frame 1, in which the screw shape shaft 4 screwed in the moving leg 16 is provided, is prevented from moving in the sliding direction and touching the inner wall, so that the operability of the lever to move the shelf is improved.

Next, the state of the shelf device installed inside the refrigerator will be explained referring to FIG. 12. The holding members are set at the predetermined positions on the inner wall 7, and the moving legs provided in the respective corners of the shelf placing frame 1 are placed on the holding members so that the shelf device is installed inside the refrigerator. In order to move the shelf up and down, the lever 3 provided on the front face of the frame 1 has to be slid. Since a user operates this lever 3 manually, the lever 3 must be provided on the front face of the frame 1 for the operability's sake, and thus a track for sliding the lever has to be provided. As a technique not to spoil the design, the slit portion is provided in the front lower face of the frame 1 and the insert piece extending from the root of the lever is inserted into this slit portion and connected to the timing belt, as described above. Accordingly, only the shelf placing frame 1 and the lever 3 are visible from the front of the refrigerator, thereby providing a refrigerator having a good design and an excellent operability.

Figure 13:
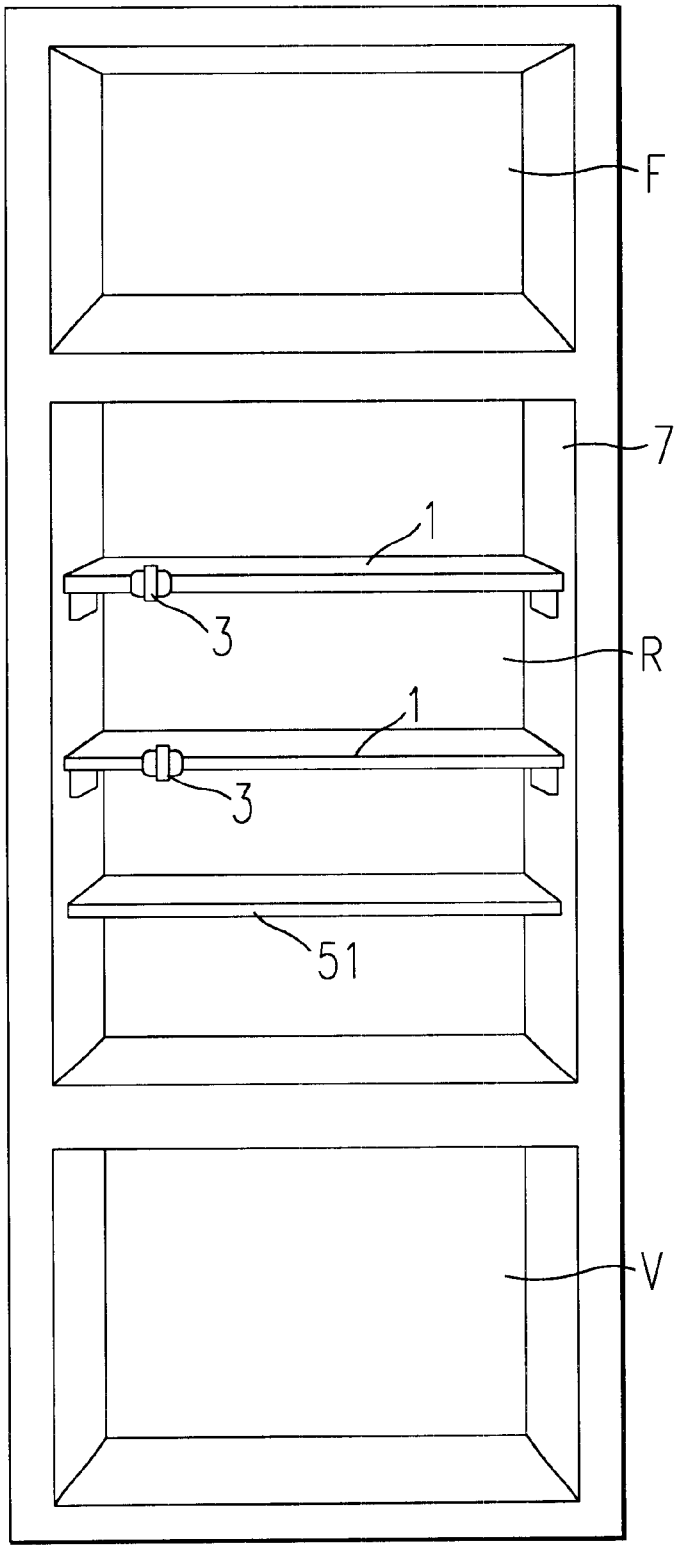
FIG. 13 is an elevational perspective view of a refrigerator according to the second embodiment of the present invention.
Figure 14:
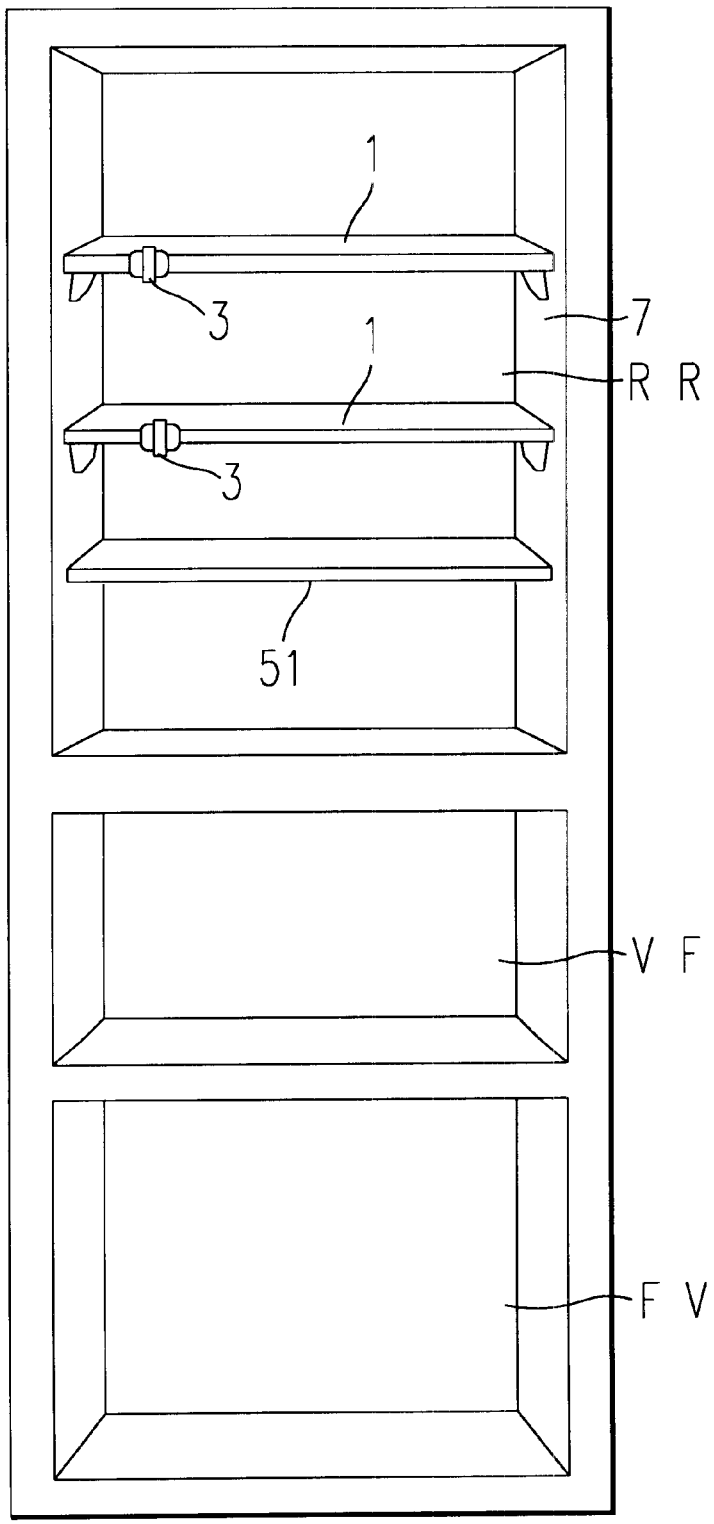
FIG. 14 is an elevational perspective view of a refrigerator according to the second embodiment of the present invention.

FIG. 13 and FIG. 14 show arrangement examples of refrigerators having the shelf devices set inside the refrigerators. FIG. 13, compartments are arranged in the order of F compartment (freezing compartment), R compartment (cooling compartment), and V compartment (vegetable compartment) from the top, and the frame 1 having the shelf and the lever 3 is provided inside the R compartment. Incidentally, a refrigerator of a two door type with the F compartment and the R compartment may be employed. In FIG. 14, compartments are arranged in the order of the R compartment, the V compartment, and the F compartment from the top, or in the order of the R compartment, the F compartment, and the V compartment from the top, and the frame 1 having the shelf and the lever 3 is provided inside the R compartment. One (1) is the frame of an up/down movable shelf, 51 is a fixed shelf, 3 is the lever provided in the shelf 1, and 7 is the inner wall.

Figure 15:
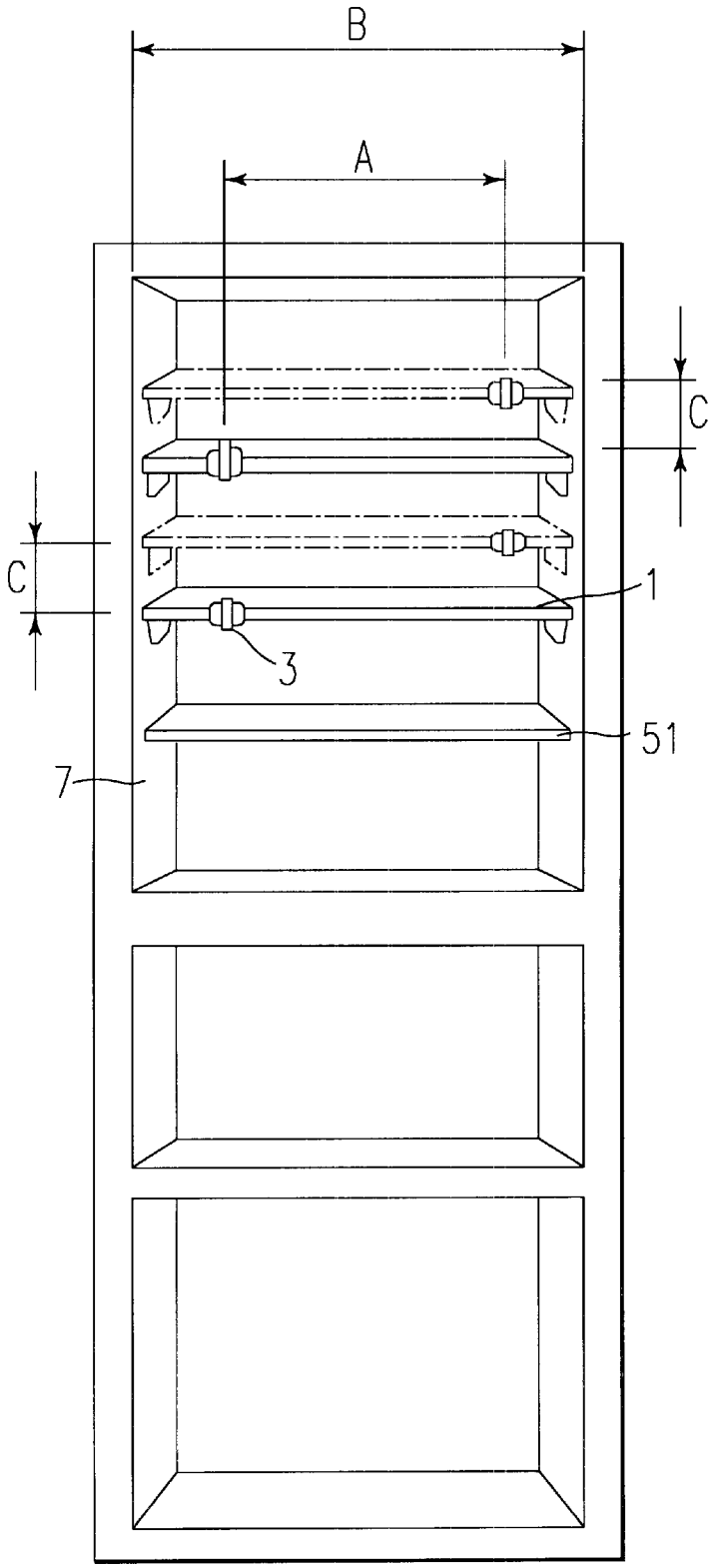
FIG. 15 is an elevational perspective view of a refrigerator according to the second embodiment of the present invention.

FIG. 15 shows a stroke of the lever 3, and a lever stroke A takes more than a half of the size B of the inside width of the refrigerator, whereby the lever 3 is moved with a small physical force. Sliding range of the lever 3 is preferably limited, so as not to include the left/right end portions, so that the lever 3 can be firmly gripped by a hand in easy operation. If an up/down movable distance C of the shelf is set to ⅕ or smaller of the lever stroke A, the operation becomes easy. This rule is not applied in a motor operation.

Figure 17:
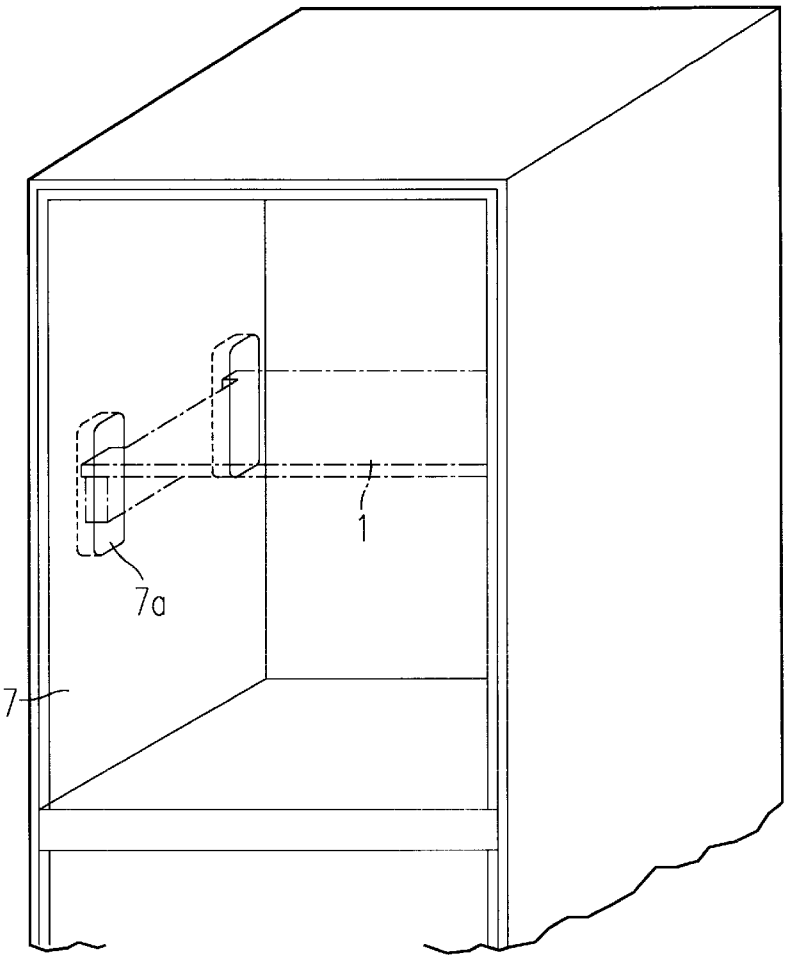
FIG. 17 is a perspective view of a refrigerator according to the second embodiment of the present invention.
Figure 16:
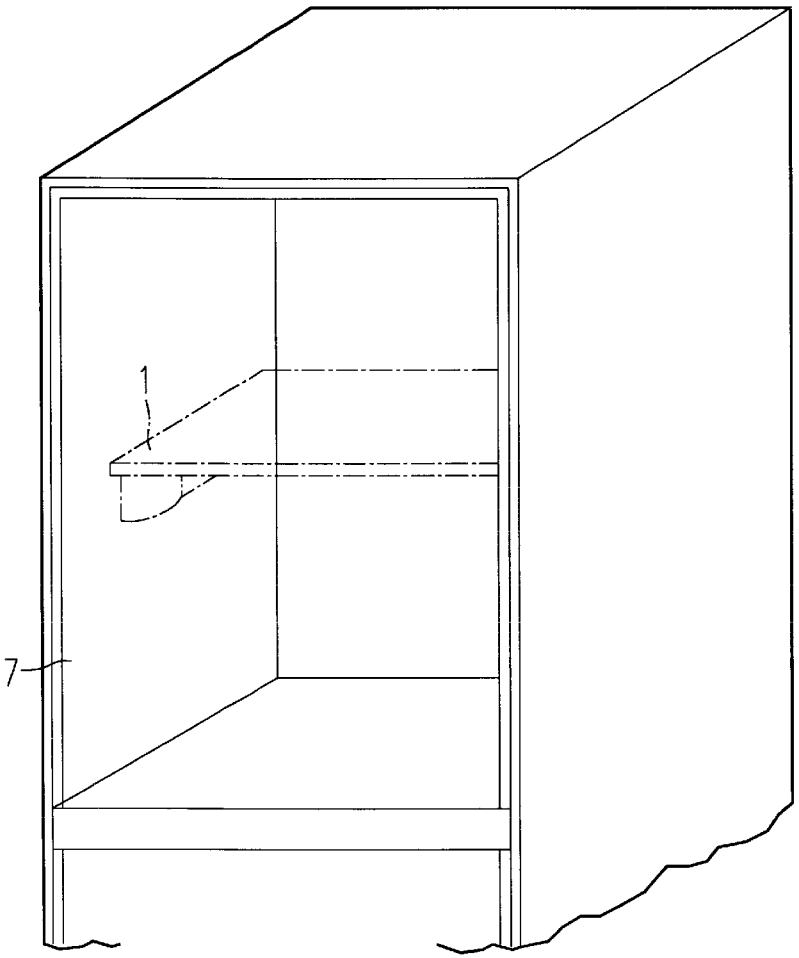
FIG. 16 is a perspective view of a refrigerator according to the second embodiment of the present invention.
Figure 19:
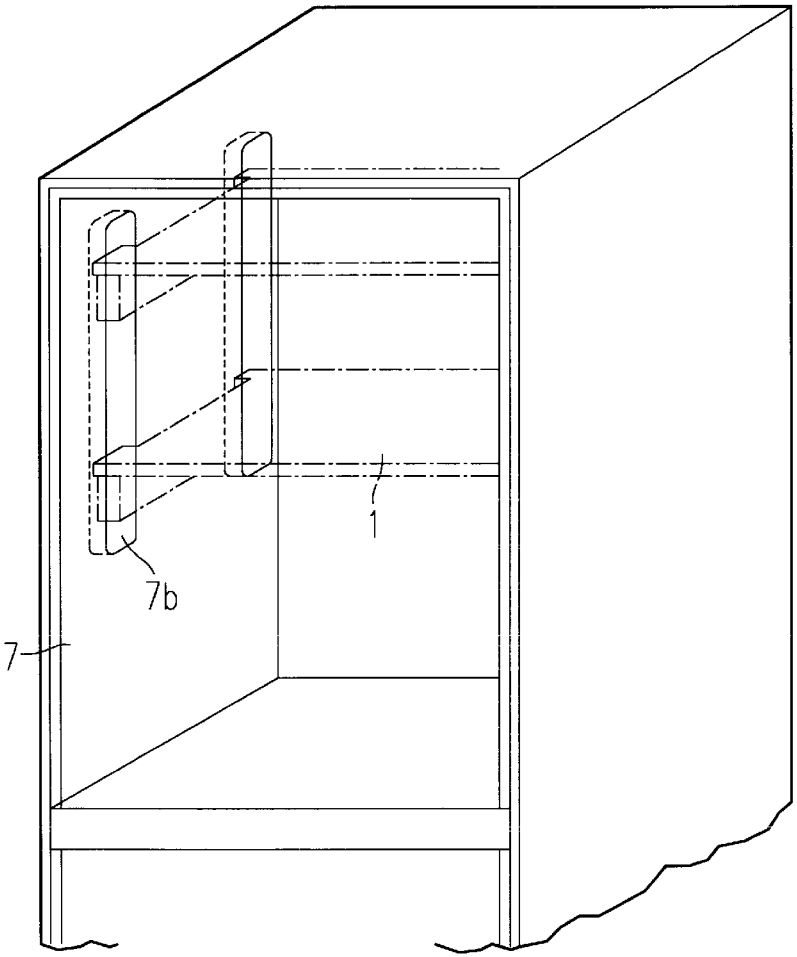
FIG. 19 is a perspective view of a refrigerator according to the second embodiment of the present invention.
Figure 18:
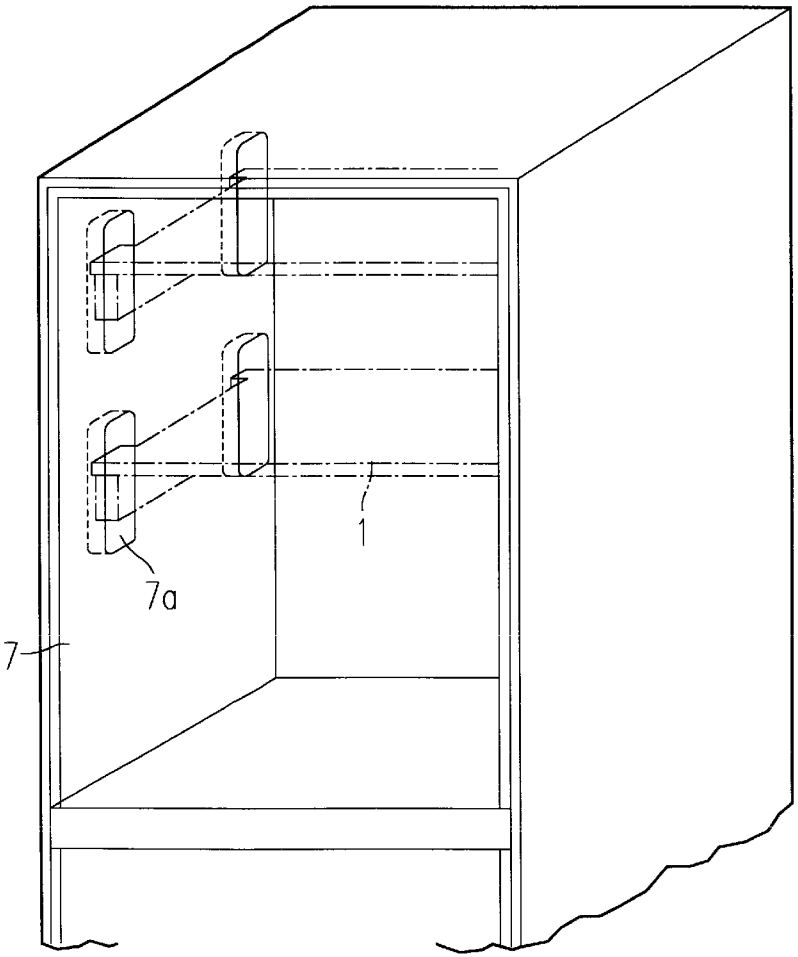
FIG. 18 is a perspective view of a refrigerator according to the second embodiment of the present invention.
Figure 20:
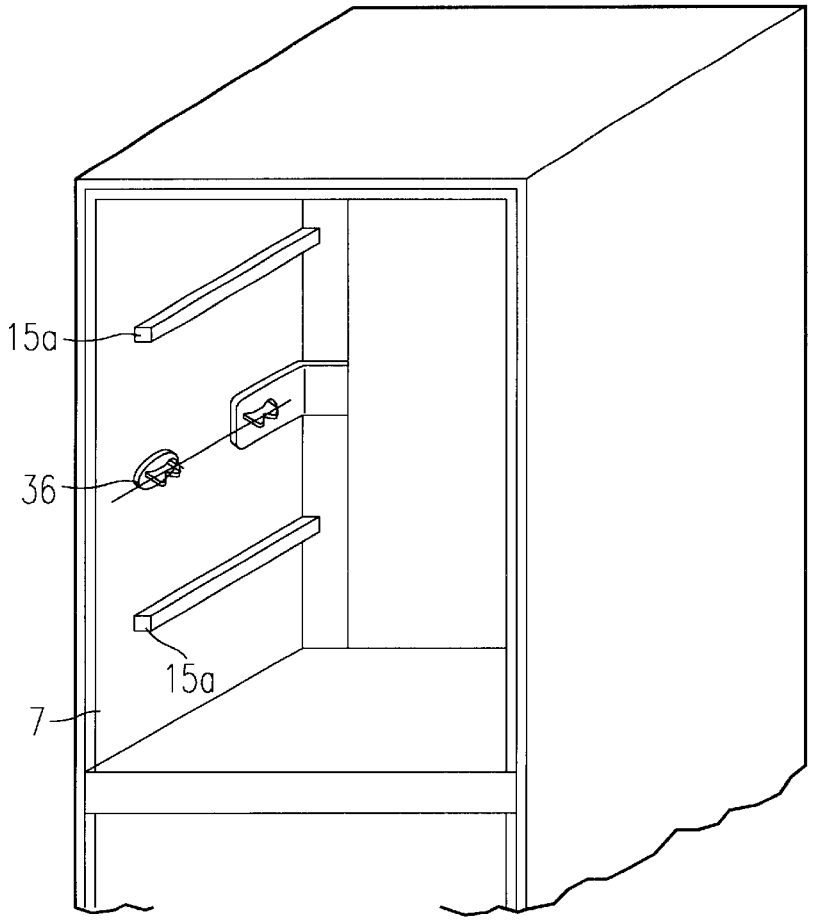
FIG. 20 is a perspective view of a refrigerator according to the second embodiment of the present invention.

FIG. 16 is a view in which the shelf is installed inside the refrigerator, FIG. 17, FIG. 18, and FIG. 19 are views in which the portion of the frame, provided with the screw shape shaft 4 (a mechanical part) is embedded between the inner wall and an outer wall of the refrigerator, and FIG. 20 is a view in which a shelf receiving portion for the mechanical part is fixed on the inner wall.

One (1) is the frame for the up/down movable shelf, 51 is a fixed shelf, 3 is the lever provided in the frame 1, 7 is the inner wall of the refrigerator, 7*a* is a recess groove provided in the refrigerator inner wall 7, 36 is a shelf receiving portion for the frame 1, and 51*a* is a shelf receiving portion for the fixed shelf 51.

FIG. 16 is the one in which there is no recess groove in the inner wall 7. The frame 1 shown by dashed lines is movable up and down. FIG. 17 is a view in which there are the recess grooves 7*a* in the inner wall 7. If there are the recess grooves 7*a*, the portion of the frame 1, provided with the screw shape shaft 4 (the mechanical part) can be embedded in each recess groove 7*a*, so that the look of the refrigerator inside is improved. FIG. 18 is a view in which there are the recess grooves 7*a* for each shelf in the inner wall 7. In FIG. 19, the recess grooves 7*a* for each shelf are not provided but the recess grooves vertically passed through are provided for common use for each shelf. Thereby, the shelves can largely range vertically. FIG. 20 is a view in which the inner wall is flat and is provided with a shelf receiving portion 36 for the up/down frame 1.

Figure 21:
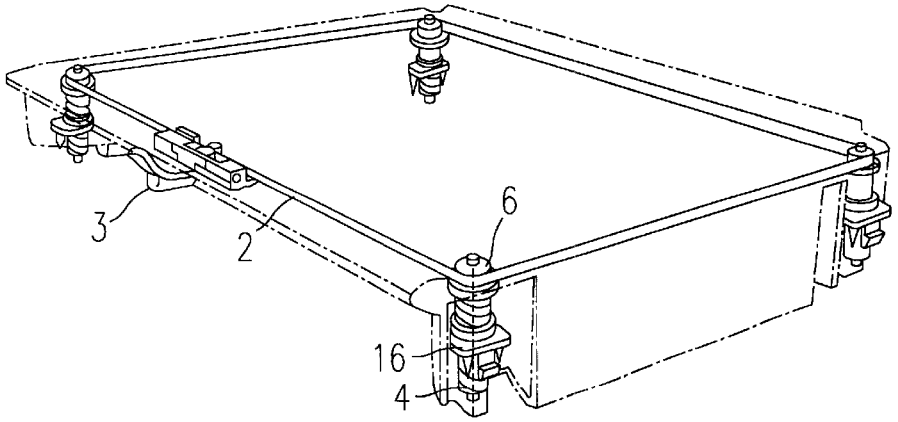
FIG. 21 is a perspective view of a screw shape shaft part and the vicinity thereof according to the second embodiment of the present invention.
Figure 22:
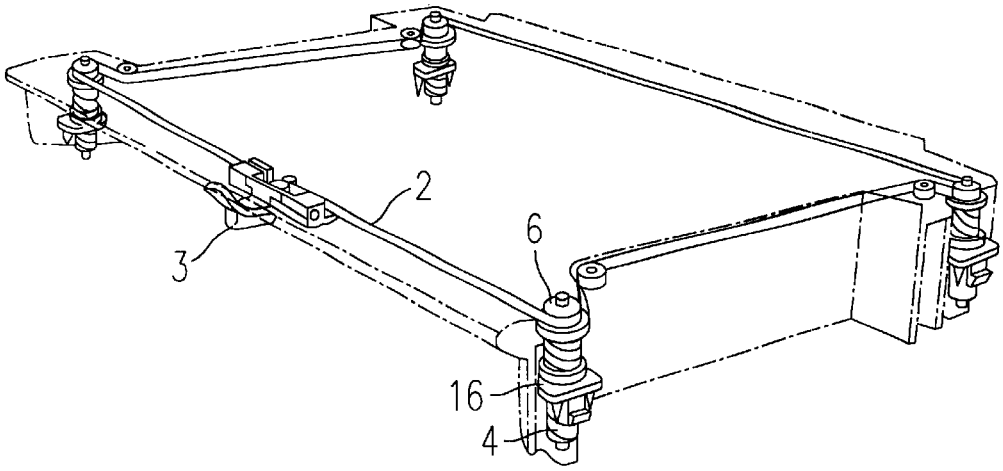
FIG. 22 is a perspective view of a screw shape shaft part and the vicinity thereof according to the second embodiment of the present invention.
Figure 23:
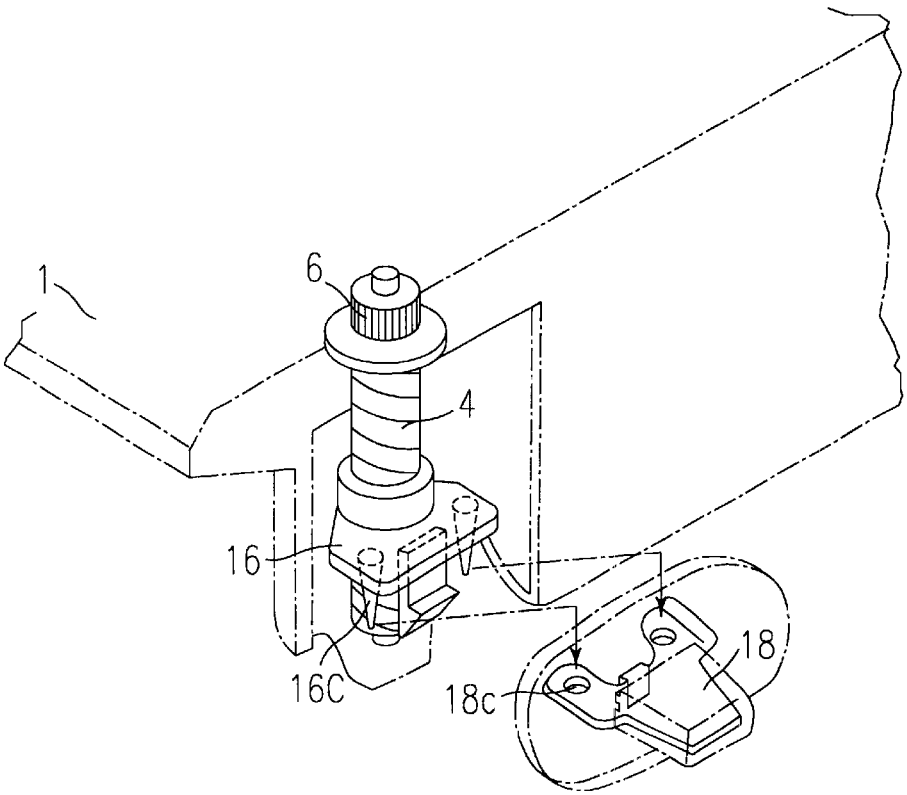
FIG. 23 is a perspective view of a screw shape shaft part and the vicinity thereof according to the second embodiment of the present invention.

FIG. 21 and FIG. 22 are perspective views of the screw shape shaft 4 and the vicinity thereof (the mechanical part). FIG. 21 shows the case where the inner wall is flat, and FIG. 22 shows the case where the screw shaft portions are arranged in the recess grooves of the inner wall. FIG. 23 is a perspective view of the screw shaft portion.

One (1) is the frame including the up/down movable shelf, 2 is the timing belt, 3 is the lever provided on the timing belt 2, 4 is the screw shape shaft, 6 is the gear, 16 is the moving leg, 16*c* is the protrusion portion, 18 is the holding member, and 18*c* is the hole portion. The holding member 18 is arranged in the inner wall of the refrigerator, for example, in its side face. The protrusion portion 16*c* provided in the moving leg 16 is inserted into the hole portion 18*c* provided in the holding member 18 to be fixed. Here, although the protrusion portion 16*c* has a triangle horn shape, the shape is not limited to that as far as the protrusion portion 16*c* can be inserted into the hole portion 18*c* to be fixed.

FIG. 24 to FIG. 29 are perspective views of the screw shape shafts 4 and the vicinity thereof (the mechanical parts).

Two (2) is the timing belt, 3 is the lever provided on the timing belt 2, 4 is the screw shape shaft, 6 is the gear, 6*b* is an auxiliary gear, 7 is the inner wall of the refrigerator, 16 is the moving board, 52 is a rib, 53 is a switch, 54 is a motor, 55 is a flexible code, 56 is an opening, 57 is a rack gear, and 58 is a worm shaft.

FIG. 24(*a*) is a perspective view of the screw shape shafts 4 and the vicinity thereof (the mechanical parts), FIG. 24(*b*) is an enlarged view of the arrow part of FIG. 24(*a*). With this structure shown in the figures, a skip of a belt tooth due to an unbalanced load can be prevented. That is, the rib 52 restricts the belt 2 in a direction to come off the gear 6, so that skip between the gear 6 and the belt 2 can be prevented.

FIG. 25(*a*) is a perspective view of the screw shape shafts 4 and the vicinity thereof (the mechanical parts). FIG. 25(*b*) is an enlarged view of the arrow part of FIG. 25(*a*). With this structure shown in the figures, a skip of a belt tooth due to an unbalanced load can be prevented. That is, the belt 2 is restricted in a direction to come off the gear 6 by means that the belt 2 is provided with teeth on both sides and the toothed belt is pinched between the gear 6 and the auxiliary gear 6*b*, so that skip between the gear 6 and the belt 2 can be prevented.

Figure 26:
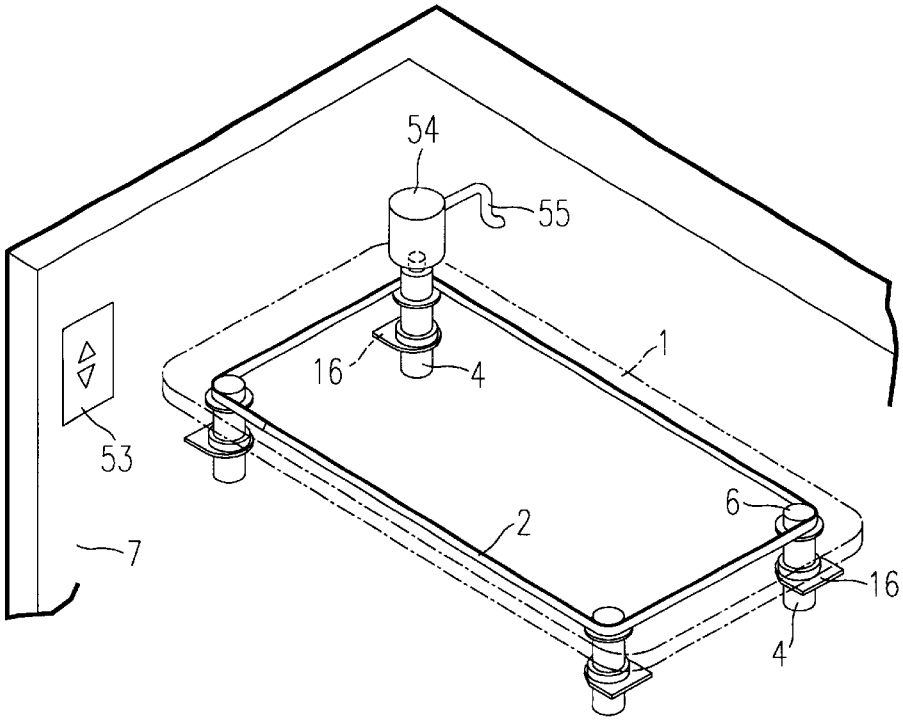
FIG. 26 is a perspective view of a screw shape shaft part and the vicinity thereof according to the second embodiment of the present invention.

FIG. 26 is a perspective view of the part where the portions around screw shape shafts 4 (the mechanical parts) are provided on the inner wall 7 of the refrigerator. Here, an operating lever (the lever 3 in FIG. 25, etc.) is replaced with the motor 54. The four movable shafts each comprising the screw shape shaft 4 and the gear 6 are conjointly rotated by directly rotating either one of the movable shafts by means of the motor 54, whereby the frame 1 for a shelf can be moved up and down. This has a structure in which the shelf is lifted up when an up triangle button of the up/down switch 53 is pressed as the shelf is stopped when the up triangle button is released, and the shelf is lowered down when a down triangle button of the up/down switch 53 is pressed as the shelf is stopped when the down triangle button is released. The motor 54 moves when this switch 53 is pressed. The flexible code 55 is connected to the motor 54.

Figure 27:
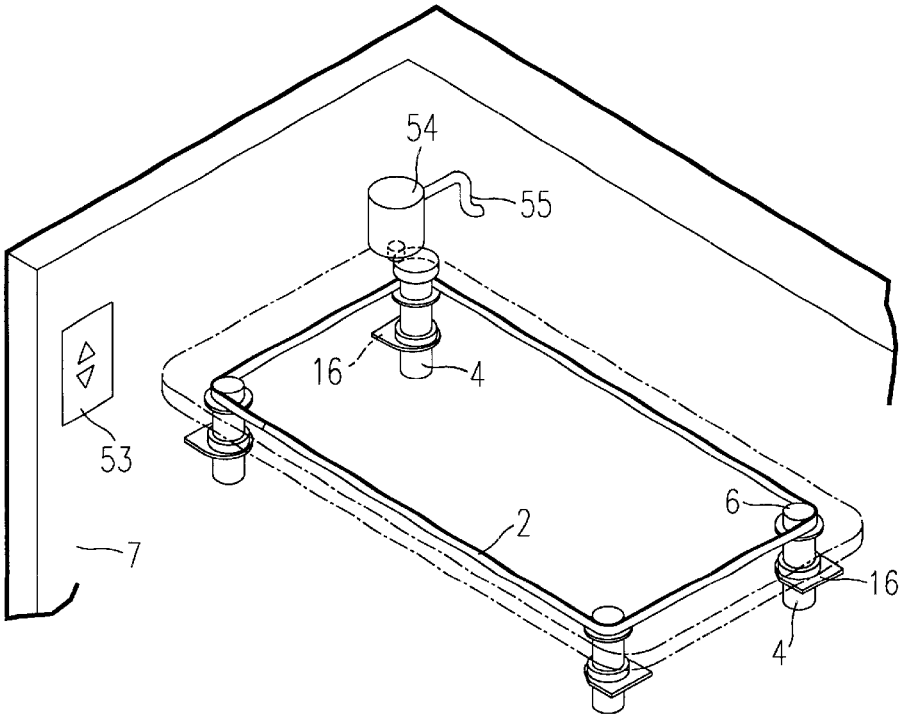
FIG. 27 is a perspective view of a screw shape shaft part and the vicinity thereof according to the second embodiment of the present invention.

FIG. 27 shows an example in which the operating lever is replaced with the motor 54 having an assistor with a worm gear.

Figure 28:
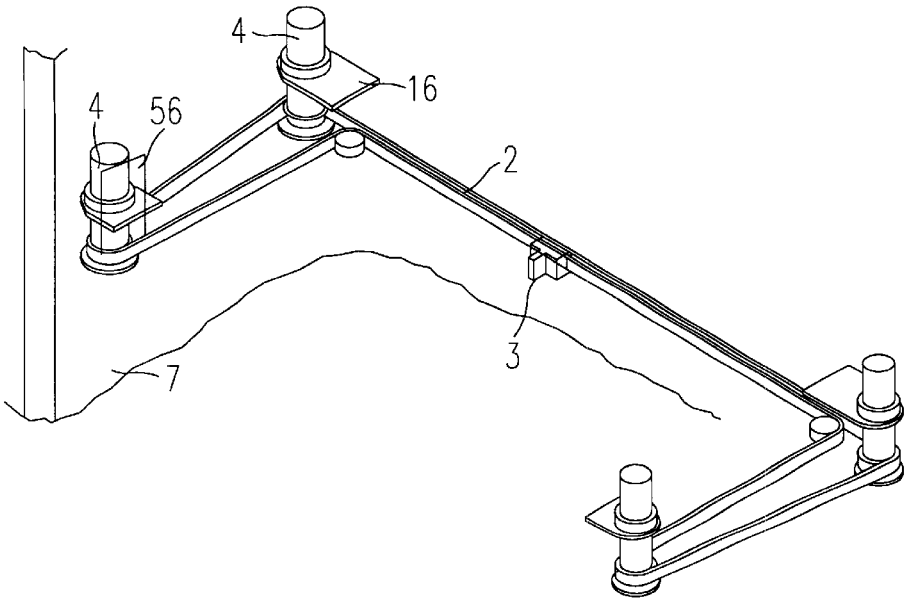
FIG. 28 is a perspective view of a screw shape shaft part and the vicinity thereof according to the second embodiment of the present invention.

FIG. 28 shows a modified example of the present embodiment in which the movable shafts each consisting of the screw shaft 4, etc. are fixedly embedded in the case consisting of an inner board and an outer board of the refrigerator. As the movable shafts are embedded in the case body and the opening 56 is provided in the inner wall 7, the moving boards 16 can be extended from that opening 56 into the inside of the refrigerator, so that a shelf (not shown) put on the moving boards 16 becomes movable up and down. Since the movable shafts are embedded, a neat design and a good look are obtained.

Figure 29:
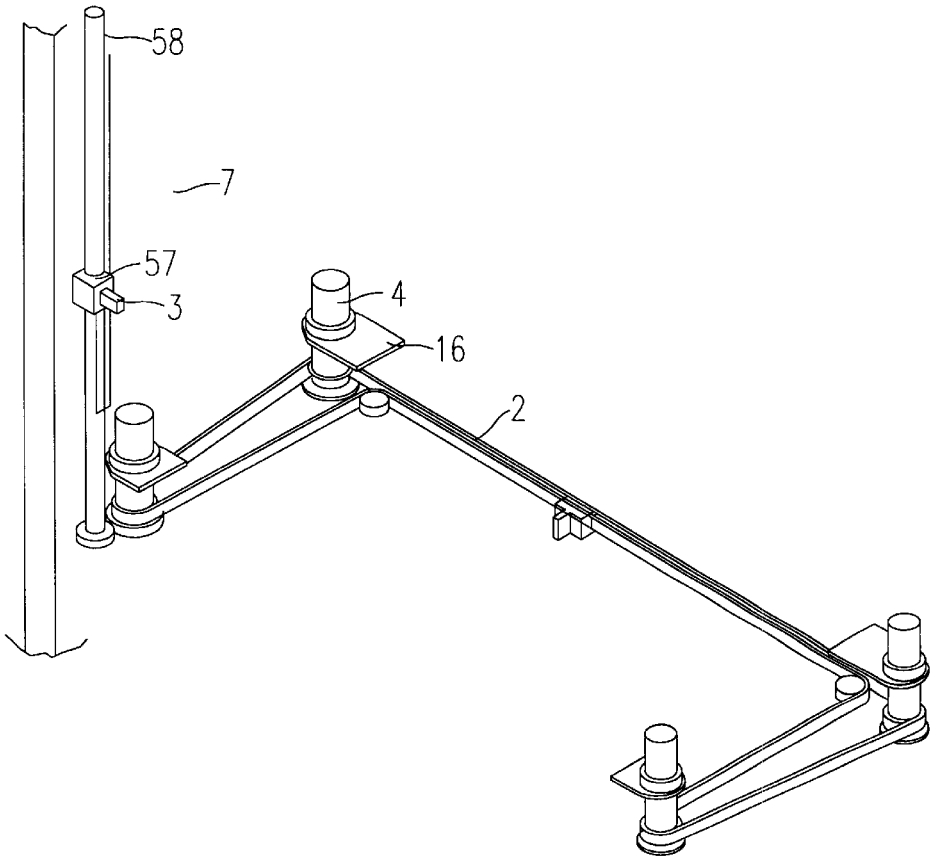
FIG. 29 is a perspective view of a screw shape shaft part and the vicinity thereof according to the second embodiment of the present invention.

FIG. 29 also shows a modified example in which the movable shafts are embedded in the case of the refrigerator, and the lever 3 is provided in the front and on one side of the case. The worm shaft 58 is operated by the lever 3 having the rack gear 57. The rotation of the worm shaft 58 is transmitted to the movable shaft (the screw shape shaft), so that the shelf (not shown) is moved up and down conjointly with the up/down movement of the lever 3.

Figure 30:
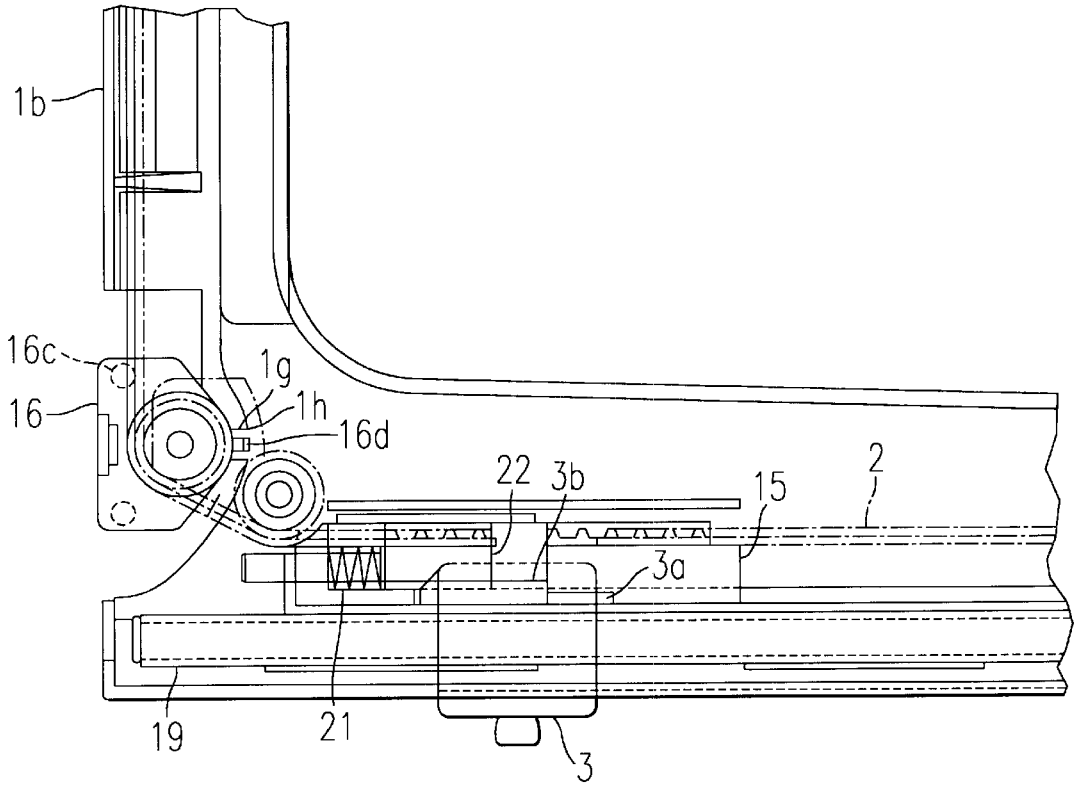
FIG. 30 is a detailed plan section in which the lever is installed according to the second embodiment of the present invention.
Figure 31:
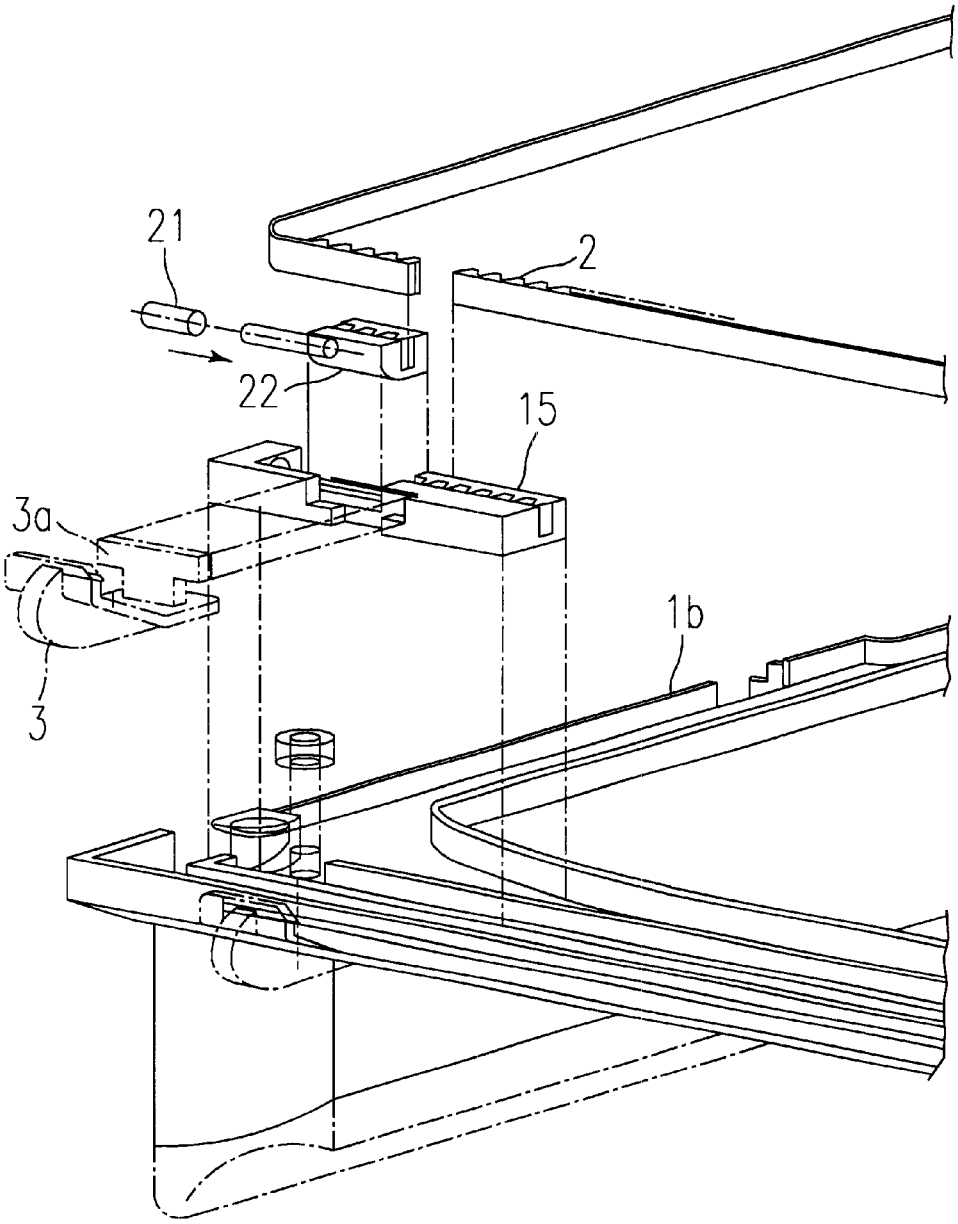
FIG. 31 is a detailed perspective view in which the lever and the timing belt are installed according to the second embodiment of the present invention.
Figure 32:
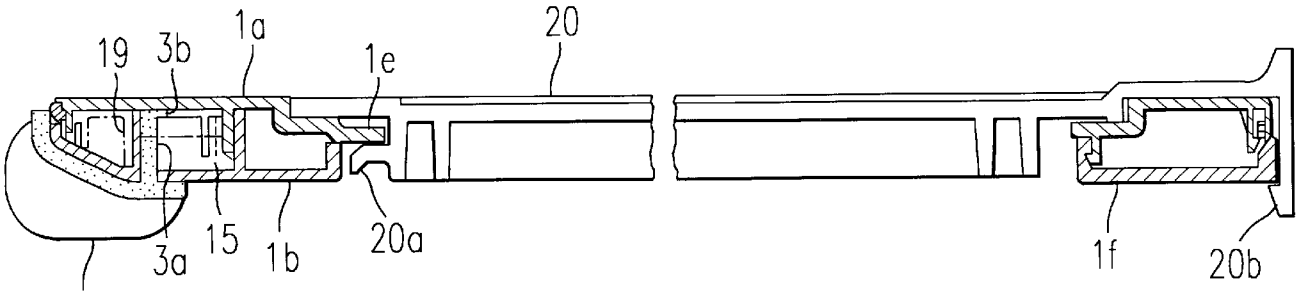
FIG. 32 is a sectional view in which a removable shelf is installed according to the second embodiment of the present invention.

FIG. 30 is a detail plan section showing installation of the lever, FIG. 31 is a detail perspective view showing installation of the lever and the timing belt, and FIG. 32 is a sectional view showing installation of the removable tray is arranged. The same numerals in these drawings as those in the aforementioned FIG. 7 and FIG. 8 show the corresponding parts. In order to lift up the shelf by sliding the lever 3 rightward in its operation, the screw shape shaft 4 has a right-hand thread, and one end of the timing belt 2 is fixed directly to the timing belt coupling socket 15 on its right side while the other end of the timing belt is connected to a slider portion 22 which is provided in the socket on its left side and has the spring 21 to give a constant tension to the timing belt 2. (In the case where the shelf is lifted up by sliding the lever leftward its operation, the reverse way is adopted.) With this, the clack of the timing belt can be prevented so as to eliminate rattling. Since the resiliency of the spring can be utilized for the lever operating force to lift up the shelf, the operating force can be reduced.

As shown in FIG. 30, an outer wall of a meshing portion 16*a* having a threaded hole in the moving leg 16 is provided with a protrusion 16*d* at its upper end and on the opposite side to the protruding piece portion 16*f* so as to face the frame, and an inner wall of a housing portion to house the screw shape shaft in the frame 1 for a shelf is provided with to ribs 1*g* so as to form a groove 1*h* between them. The protrusion 16*d* is positioned inside the groove 1*h* to prevent the moving leg from rotation, so that the moving leg 16 can be held without rotating until the frame having the incorporated timing belt and moving leg has been set in the refrigerator main body.

The frame reinforcing plate 19 is arranged on the front inside of the frame 1, along the track of the lever 3 which moves along the front part of the frame 1. Accordingly, even when the weight of food put on the shelf is increased, the flexure of the frame can be minimized, and a rectilinear motion in the lever operation can be secured, so that the operability can be maintained excellently.

Twenty (20) shown in FIG. 32 is a shelf removably placed on the frame 1. The shelf is provided with a U-shaped rib 20*a* opening forward in its front lower part so as to catch a flange portion 1*e* of the frame 1. Further, the rear part of the shelf 20 is formed into an L-shape so as to cover and wrap the rear part of the frame 1, and a claw 20*b* provided at the tip of the L-shaped rear part of the shelf 20 is engaged with a lower face 1*f* of the rear part of the frame 1. Since the shelf is engaged with the frame in the front part and the rear part, the shelf does not slip off from the frame or does not rattle, and further, the integrated construction of the frame and shelf with such engagement leads to the improved strength of the entire shelf.

Figure 33:
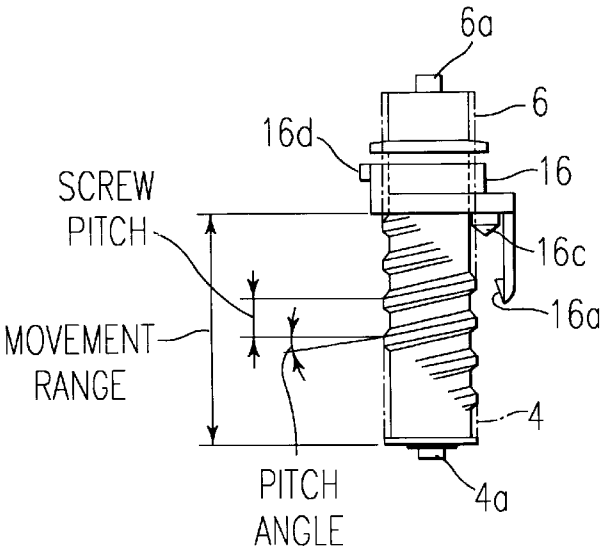
FIG. 33 is a view in which the screw shape shaft and the moving leg are combined according to the second embodiment of the present invention.

FIG. 33 is a view in which the screw shape shaft and the moving leg are combined. In the drawing, 4 is the screw shape shaft with which the gear 6 is integrally formed on the same axis, and 16 is the moving leg into which the screw shape shaft is screwed. An average weight load of food placed on one shelf in a general household refrigerator is supposedly about 5 kilograms or 10 kilograms at the most. It is supposed, on the other hand, that the lever operating physical force of approximately 4 kilograms corresponds to a level by which even a female can operate. Taking these into consideration, the screw pitch (advancing distance per rotation of the screw portion) of the screw shape shaft 4 is preferably set to 9 mm or less and the screw lead angle (spiral angle of the screw thread) is preferably set to 150 degree or less, on a calculation from the stroke of the lever in a case where the up/down movable distance of the shelf is set to approximately 40 mm. Accordingly, the physical force in manual operation to set an up/down position of the shelf is reduced, and the tension caused in the timing belt can be alleviated, so that leading the reliability is improved.

Figure 34:
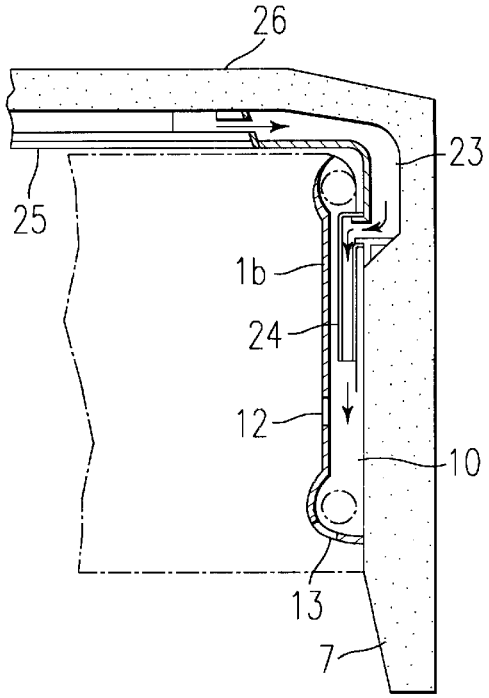
FIG. 34 is a plan section showing an air course structure according to the second embodiment of the present invention.

FIG. 34 is a plan section showing an air course structure inside the refrigerator. The same numerals in this drawing as those in the aforementioned FIG. 7 show the corresponding parts, 12 and 13 are air outlets, 23 is a face duct for supplying cool air provided between the refrigerator inner board 25 and the refrigerator outer board 26, and 24 is a connecting duct. Part of cool air blowing from the refrigerator rear face to the inside of the refrigerator is shared to the side face duct 23 so that cool air is led into the hollow part 10 of the frame 1 via the connecting duct 24 provided at the outlet of the side face duct 23. Though the cool air blowing from the side face duct 23 blows perpendicularly to the refrigerator inner wall face it is changed to a flow along the refrigerator inner wall by the connecting duct 24 and released to the hollow part 10 as cool air directed to the forward of the refrigerator. This structure is to avoid any obstacles as air course resistance, such as the screw shape shaft provided in the frame, and the cool air led and released into the hollow part 10 blows out from the air outlets 12, 13 of the side face and the front side of the frame to the inside of the refrigerator, through this hollow part 10. Thus, such air course resistance as obstruction by the screw shape shaft necessary for lifting/lowering the shelf is not caused, so that even a small volume of cool air can flow up to the front face of the frame, whereby the cooling efficiency in the refrigerator can be improved, saving energy.

In the above second embodiment, the frame reinforcing plate 19 is arranged on front inside of the frame 1, along the track of the lever 3 which moves along the front part of the frame 1. However, an extrusion molded member of metal (e.g., aluminum) may be used for the front part of the frame 1 to arrange the lever 3 and the timing belt 2 inside the extrusion molded part, whereby deformation of the shelf due to the loaded weight of food is minimized, and the operability of the lever can be maintained excellently.

Third Embodiment

One embodiment of the present invention will be explained below referring to drawings.

Figure 35:
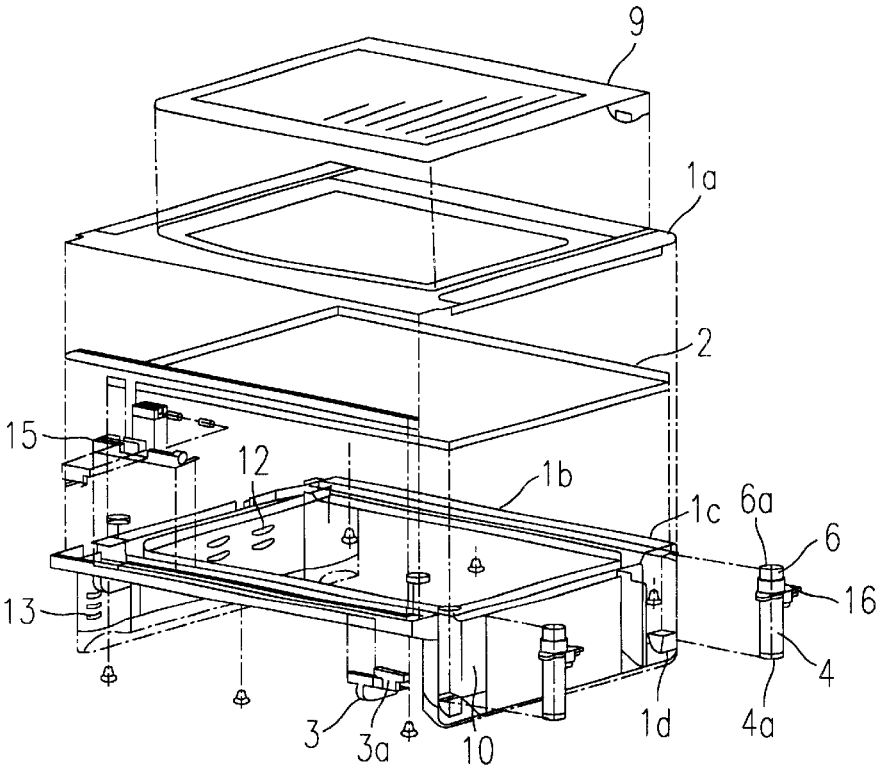
FIG. 35 is an assembly perspective view of a shelf device according to the third embodiment of the present invention.
Figure 36:
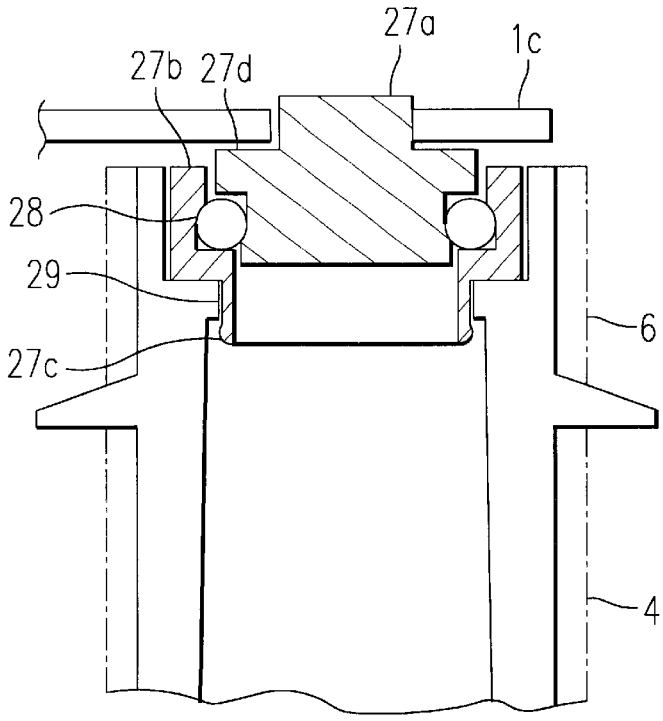
FIG. 36 is a detailed section of an inner part of a gear according to the third embodiment of the present invention.
Figure 37:
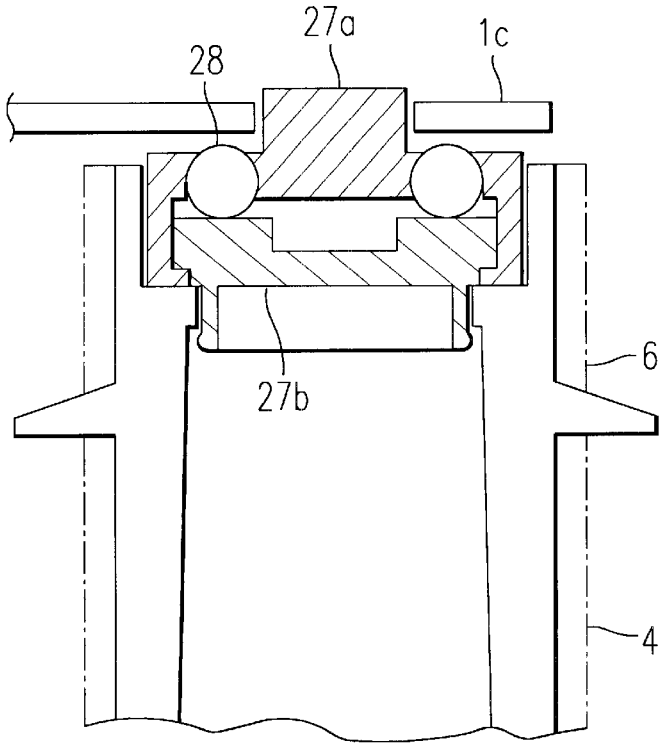
FIG. 37 is a detailed section of the inner part of a gear according to the third embodiment of the present invention.
Figure 38:
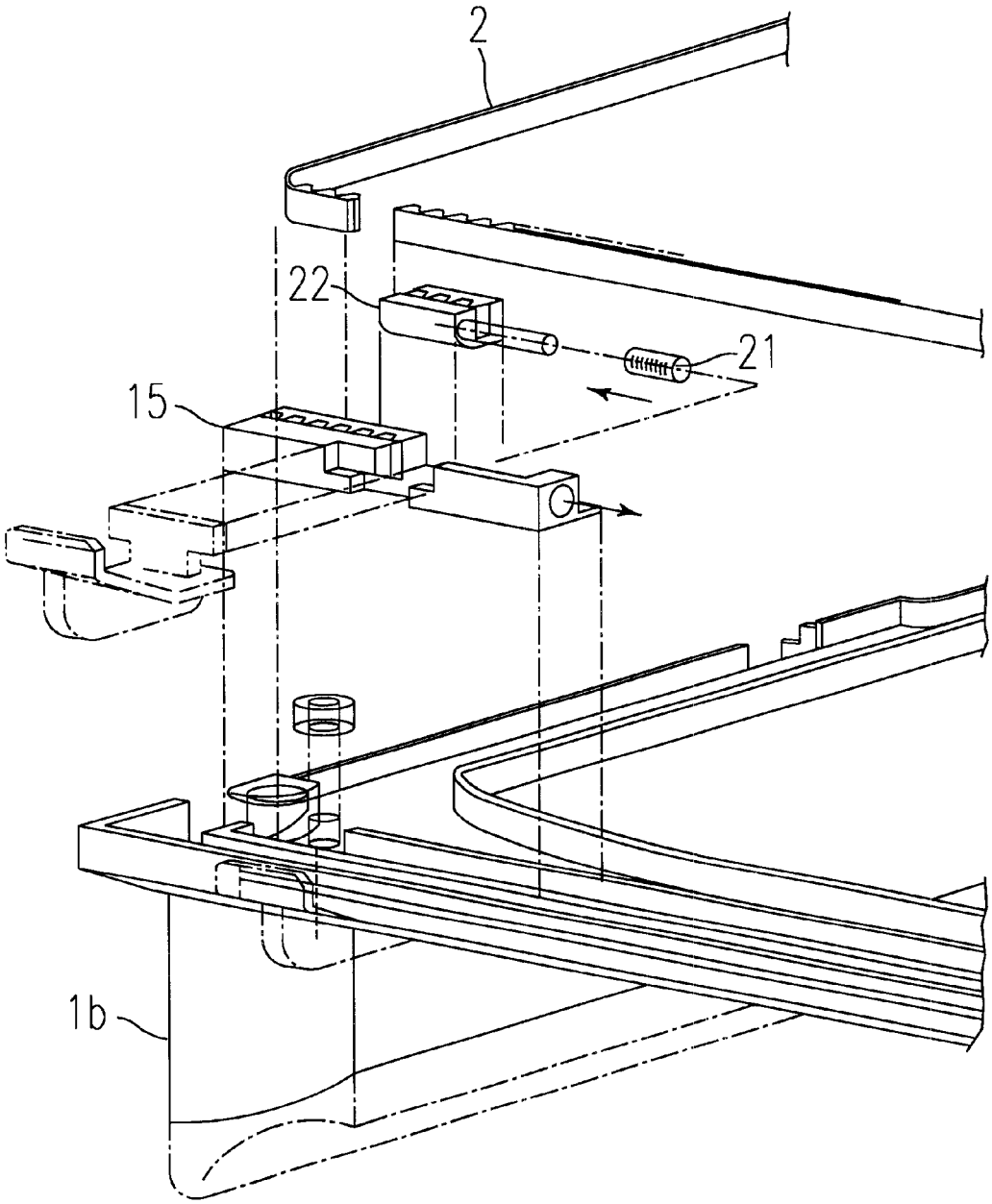
FIG. 38 is a detail perspective view in which a lever and a timing belt are installed according to the third embodiment of the present invention.
Figure 39:
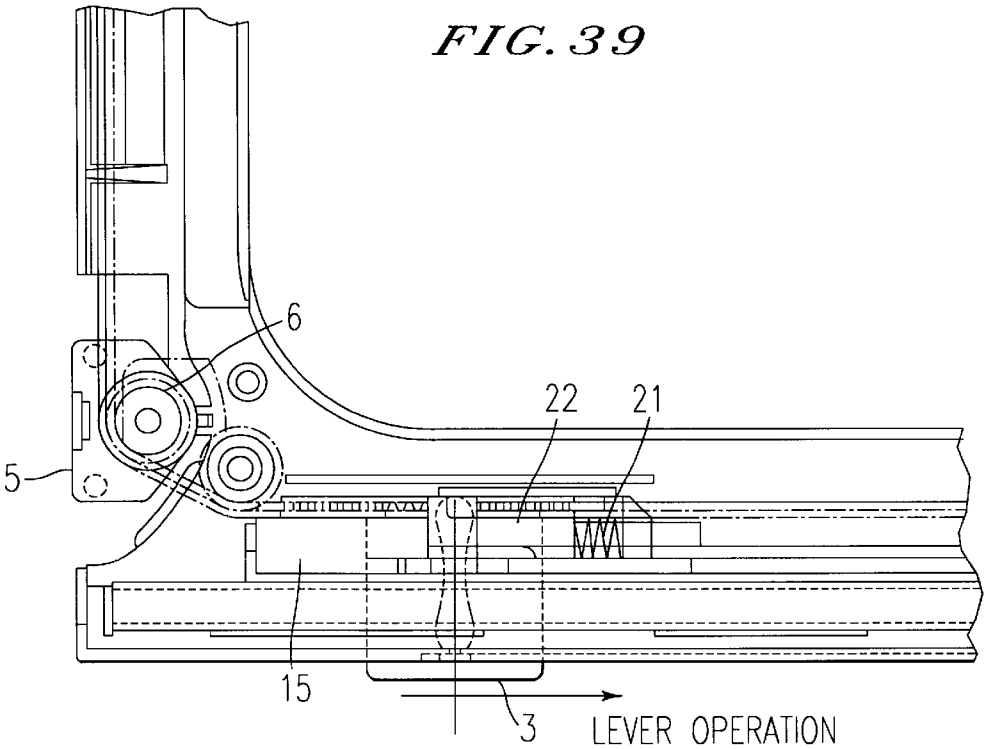
FIG. 39 is a detailed plan section in which the lever is installed according to the third embodiment of the present invention.
Figure 40:
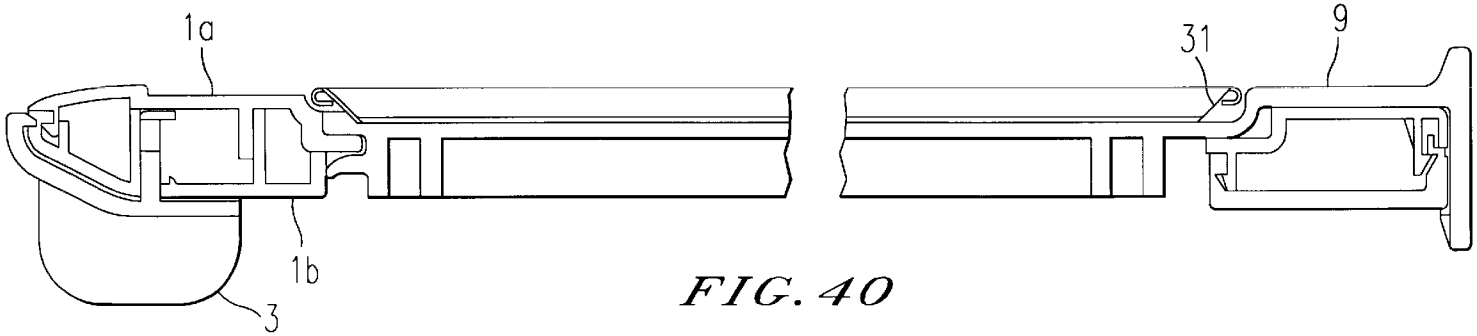
FIG. 40 is a sectional view of the installation of a removable shelf according to the third embodiment of the present invention.
Figure 41:
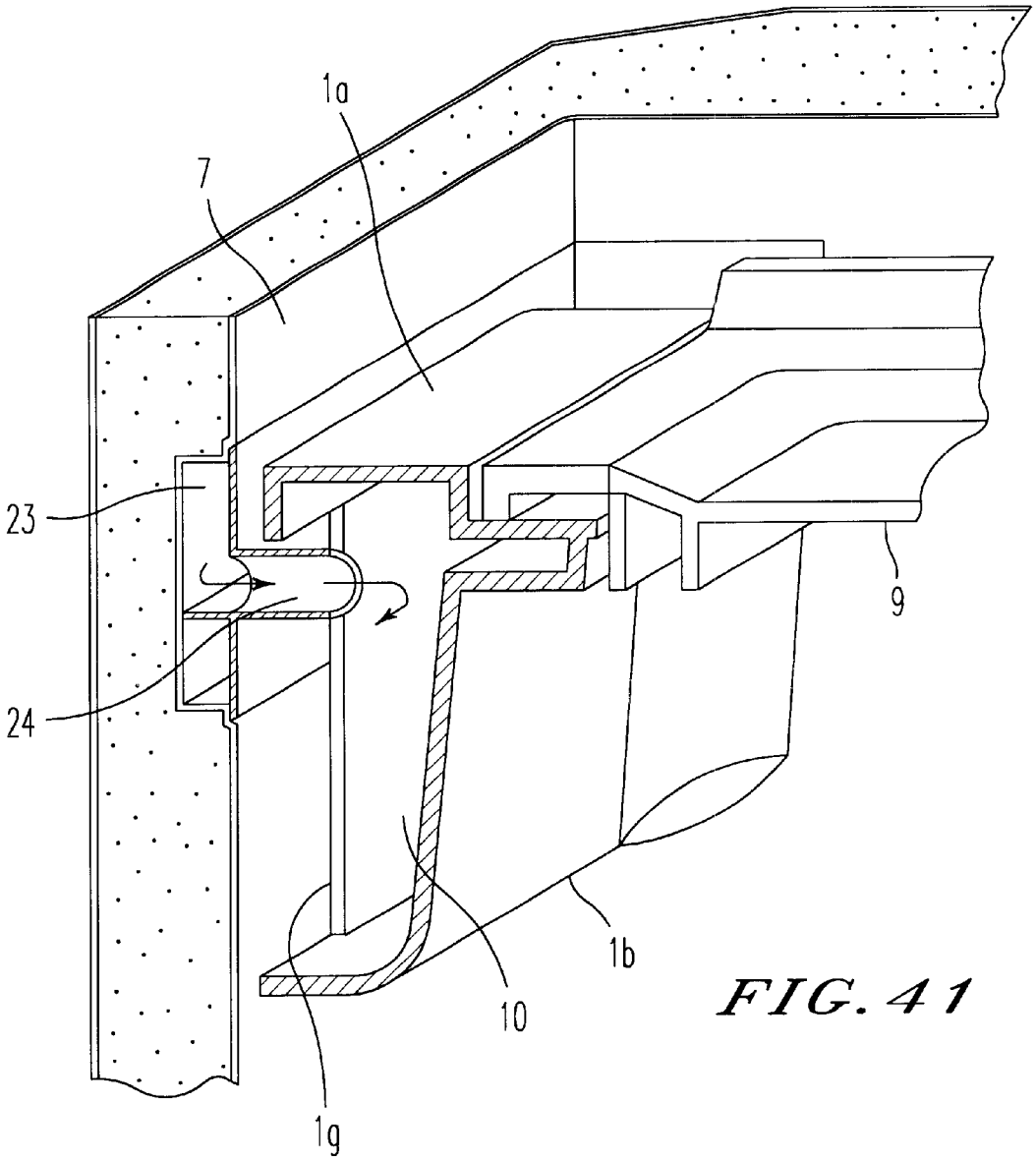
FIG. 41 is a sectional view of a cooling method for a resin shelf according to the third embodiment of the present invention.
Figure 42:
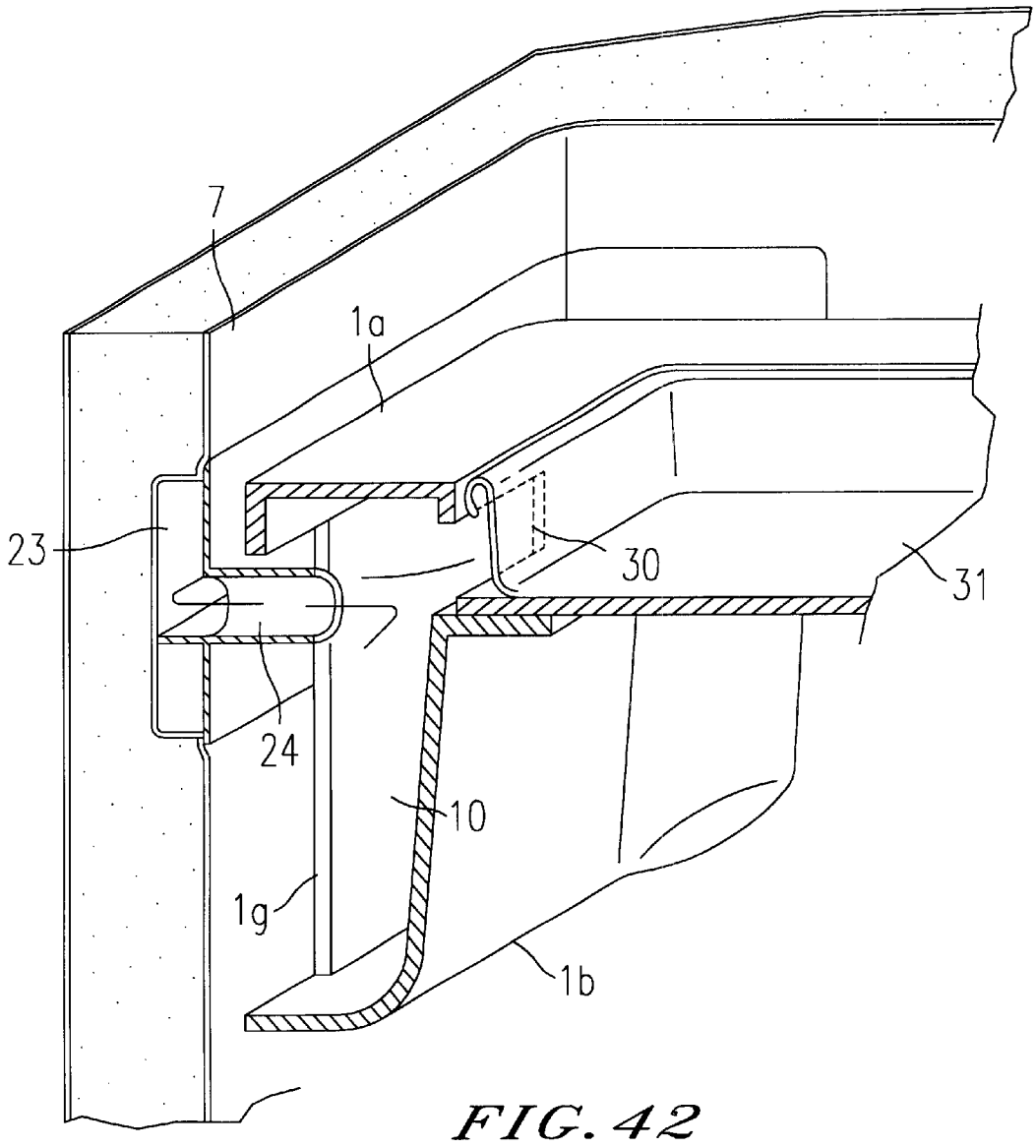
FIG. 42 is a sectional view of a cooling method for a metal shelf according to the third embodiment of the present invention.

FIG. 35 is an assembly perspective view of a shelf device of the present invention, FIGS. 36, 37 are detailed sections of inner parts of screw shape shaft gears, FIG. 38 is a detailed perspective view in which a lever and a timing belt are installed, FIG. 39 is a detailed plan section in which the lever is installed, FIG. 40 is a sectional view of the installation of a removable tray, FIG. 41 is a sectional view of a cooling method for a resin tray, FIG. 42 is a sectional view of a cooling method for a metallic tray, and FIG. 43 is a perspective view showing a knob shape of the lever.

In the drawings, 1 is a frame for placing a shelf on it, which forms a frame body in a hollow shape. The frame 1 consists of an upper frame 1*a* and a lower frame 1*b*, and a hollow part 10 is formed by assembling them. Utilizing the hollow part 10 a timing belt is mounted along the outer periphery of the frame 1.

The lever 3 is arranged so as to move along one side of the frame 1, and an insert piece 3*a* provided in the lever 3 is inserted through a slit portion provided in a lower face of the frame 1 into the inside of the frame 1 and is fitted into a socket 15 of the coupling means connected to the timing belt, so that the lever 3 is fixedly coupled with the timing belt 2. Therefore, the timing belt 2 is rotationally moved by sliding the lever 3.

The gears 6 meshing with a rack (not shown) of the timing belt 2 and to rotate are arranged on a rotational/moving line of the timing belt 2 and in the respective corners of the frame 1, and the screw shape shaft 4 is integrally formed with the gear 6 on the same axis.

The screw shape shaft 4 rotates when the gear 6 is rotated by the timing belt 2.

Five (5) is a moving leg having a screw tapped hole screwed onto the screw shape shaft 4 and is fed to move up and down in accordance with the rotation of the screw shape shaft 4.

In the respective corners of the frame 1, small shafts 27 and 4*a* coaxially protruding from the gear 6 and the screw shape shaft 4 are supported on the bearings 1*c* and 1*d* provided in the frame 1 and the screw shape shafts 4 are housed.

In FIGS. 36 and 37, a small shaft 27 is embedded inside the gear 6. The small shaft comprises an upper supporting shaft 27*a* to be inserted into a hole of a bearing 1*c* of the frame 1 and a holding portion 27*b* provided with a claw 27*c* engaged with a step portion inside the gear, and a plurality of rotatable balls 28 is provided between the upper supporting shaft 27*a* and the holding portion 27*b* so as to enable them to rotatably engage with each other. The gear 6 rotates while the lower face of the bearing 1*c* of the frame 1 is kept in contact with a seat portion 27*d* of the upper supporting shaft 27*a* or with the rotatable balls as shown in FIG. 36 or FIG. 37, respectively.

Since the balls 28 are provided, the lever operation becomes smooth. Further, in FIG. 37, the upper faces of the balls are protruded from the upper face of the gear so as to keep the lower face of the bearing of the frame in contact with the balls during rotation of the gear, so that even if the upper face of the gear is pressed against the lower face of the bearing by the load of food or the like placed on the shelf, a brake phenomenon on the rotation of the gear is extremely small. Consequently, the operating physical force of the lever is improved.

As shown in FIGS. 38, 39, in order to lift up the shelf by sliding when the lever 3 in the right direction in its operation, the screw shape shaft 4 has a right-hand thread, and the timing belt 2 is installed in such a manner that one end of the timing belt is fixed to the socket 15 of the timing belt coupling means on its left side while the other end of the timing belt is connected to the slider portion 22 which is provided in the socket on its right side and has the spring 21 to give a constant tension to the timing belt 2. (In the case where the shelf is lifted up by sliding the lever leftward in its operation, the reverse way is adopted.)

With the above, since the slack of the timing belt can be absorbed by the resiliency of the spring in the lifting up process where the load on lever operation becomes the most, a tooth skip of a belt (position mismatch between the teeth of the gear and the teeth of the belt) can be prevented.

FIG. 40 is a sectional view in which the removable shelf is installed. In the drawing, 1*a* is an upper side frame, 1*b* is a lower side frame, 3 is a lever, 9 is a resin shelf, and 31 is a metal tray. The metal tray 31 is placed on the upper part of the resin shelf 9.

As shown in the above, the strength of the resin shelf 9 can be reinforced with the metal tray 31.

If the shelf placed on the frame is made of a metal, the strength of the shelf is increased.

FIG. 41 and FIG. 42 are plan sections showing air course structures.

FIG. 41 shows an air course structure with a resin shelf 9, wherein cool air does not directly blow against the shelf 9. On the contrary, FIG. 42 shows the air course structure with a metal tray 31, wherein cool air directly blows against the tray 31.

In FIG. 42, part of cool air blowing from the refrigerator rear face to the inside of the refrigerator is shared to a side face duct 23 and taken into the frame 1 for placing the shelf via a protrusion ducts 24 and a notch portion 18 provided in the frame at a rear and side portion. The cool air taken in the frame is distributed in the frame, utilizing the hollow part 10 of the frame 1 (1*a*, 1*b*, 1*g*, and the like), that is, a part of the cool air blows against the metal tray placed on frame 1, through a hole portion 30 provided in the frame and the other part of the cool air blows out from the air outlets 12 and 13 (refer to FIG. 34) of the side face and the front side of the frame.

With the above, the entire shelf is uniformly cooled down, so that the temperature distribution is improved. Since a storing space between shelves is also cooled down uniformly, so that the temperature distribution of the entire room is improved.

FIG. 43 is a perspective view showing a shape of the knob of a lever provided in the frame 1 for placing a shelf on it. The knob 3*b* of the lever 3 is formed to have recesses 3*c* corresponding to abdominal portions of fingers, so that the lever 3 can be easily pinched to put thereon.

Operational errors are prevented by providing the lever with signs or the like showing the moving of the shelf (here, down/up).

In the above, the frame 1 is kept in its height position against the weight of food on the shelf by the frictional resistance on the screw shape shaft 4 and the gear 6 even in case where the belt 2 is cut.

Even when there is an unbalanced load on the shelf 20, there is no deformation in the shelf 20 due to the rigidity of the frame 1.

The height positions of four screw shafts 4 are preferably set at the same level. In the beginning of the assembly, the height positions of the screw shafts 4 are set at the highest position or the lowest position, so that the height positions of the screw shape shaft 4 can be easily set for the same height by abutting the screw shape shaft.

The moving speed of the frame 1 may be set at a level, for example, so as not to move food placed on the shelf 1 on the frame.

The lever 3 may be arranged in any position on the frame where the lever 3 causes inconvenience for getting become an food in and out and where the lever is easy to be used by a user.

When the shelf on the frame 1 (the tray or the shelf placed on the frame 1) is at a high position, the frame 1 may be lowered by the lever 3, so that food placed on the back part of the shelf is easily seen and taken out. When the shelf is at a low position, the frame 1 may be lifted up by the lever 3, so that food can be easily taken out by a user with an easy posture.

The lever 3 is preferably small to such an extent that the lever 3 can be easily pinched.

A cleaning characteristic is improved by making the shelf or the tray 9, 20, 31 removable. If a recess portion or a groove portion is provided in the peripheral part of the shelf, clean inside the refrigerator can be maintained. That is, even if soup or the like of food flows out, it is stopped at the recess portion or the groove portion and does not flow to the frame 1. If the shelf covers the whole frame 1, the inside of the shelf refrigerator can be maintained more cleanly.

Furthermore, each constitution described in the above embodiments may be combined optionally.

We claim:

1. A refrigerator provided with a shelf device comprising a frame for placing a shelf or the like on it, arranged inside the refrigerator, a timing belt provided inside the frame, a lever provided on the timing belt, and a means for moving the frame in an up/down direction in operative connection with the timing belt rotationally moved by moving the lever.

2. The refrigerator according to claim 1, characterized in that a corner portion of the frame is extended to provide an extended portion, the moving means is placed inside the extended portion, and a groove portion in which the extended portion is movably received is provided inside the refrigerator.

3. The refrigerator according to claim 1, characterized in that the shelf device is employed for a member for closing a ceiling part of a compartment provided inside the refrigerator.

4. The refrigerator according to claim 1, characterized in that the shelf device is employed for a bottom of a door pocket provided in a door of the refrigerator.

5. The refrigerator according to claim 1, characterized in comprising an open/close door to close a front face of the refrigerator and a partition wall to partition the inside of the refrigerator plurally, wherein the partition wall is movable.

6. The refrigerator according to claim 1, characterized in that the frame is provided with a cool air intake for taking cool air in from a cool air supply duct provided between an inner wall and an outer wall of the refrigerator and a cool air outlet for sending out the cool air to the inside of the refrigerator.

7. A refrigerator according to claim 1, characterized in that the shelf device further comprises a holding means and a fixing means; the frame is provided with a screw shape shaft pivotally supported in an up/down direction; the moving means is provided with a meshing portion for meshing with the screw shape shaft, and a flange portion having a locking portion at one end thereof; the holding means is provided with an engaging portion for engaging with the locking portion at the time when the moving means is placed on the holding means from the above, and an insert piece extending from a placing face where the moving means is placed; and the fixing means is provided with a pinching portion to insert and fix the insert piece and an abutting portion arranged on an open side of the pinching portion to stop the locking portion of the moving means abutting against the abutting portion; and the fixing means is fixed to an inner wall of the refrigerator so that the moving means is fixedly held on the inner wall with aid of the holding means to make the frame movable in the up/down direction.

8. The refrigerator according to claim 7, characterized in that the locking portion of the moving means extends in an axial direction of the screw shape shaft from the flange portion, and the engaging portion of the holding means is arranged approximately perpendicularly to the placing face.

9. The refrigerator according to claim 7, characterized in that the insert piece of the holding means is arranged approximately horizontally or in a diagonal direction to the placing face, and the pinching portion of the fixing means is embedded in an inner wall of the refrigerator.

10. The refrigerator according to claim 7, characterized in that a protrusion or a hole portion is provided in the flange portion of the moving means and a hole portion or a protrusion is provided in the holding means to engage with the protrusion or hole portion of the moving means.

11. The refrigerator according to one of claim 7, characterized in that a force of a sliding movement of the lever provided on the timing belt is transmitted via the timing belt to a gear which is fixedly and coaxially provided at one end of the screw shape shaft and engaged with the timing belt, so that the screw shape shaft is rotated.

12. The refrigerator according to claim 11, characterized in that the timing belt is arranged in an inside peripheral part of the frame, and the screw shape shafts engaged with the timing belt to rotate are provided in at least two corners of the frame.

13. The refrigerator according to claim 11, characterized in that a screw pitch of the screw shape shaft is set at 9 mm or less, and a lead angle of the screw shape shaft is set for 15° degree or less.

14. The refrigerator according to one of claim 7, characterized in that a protrusion is provided in the moving means on an outer wall of the meshing portion of the moving means, and a groove is provided in the frame correspondingly to the protrusion, on an inner wall of a housing portion for the screw shape shaft, so that the groove guides the protrusion as a track.

15. The refrigerator according to claim 1, characterized in comprising a connecting duct which is provided in the frame so as to be disposed near an outlet of a cool air supply duct provided between an inner wall and an outer wall of the refrigerator, the connecting duct conducting cool air forward from the outlet of the cool air supply duct to the front inside of the frame.

16. The refrigerator according to claim 1, characterized in that the shelf device further comprises a timing belt coupling means consisting of a socket and a slider portion which is slidable to the socket and loaded with a spring toward the socket, and the lever and one end of the timing belt is connected to the socket and the other end of the timing belt is connected to the slider portion, so that the frame is moved up and down conjointly with sliding of the lever via timing belt rotationally moved.

17. The refrigerator according to claim 16, characterized in that the lever is provided with an insert piece formed by extending a root of the lever, and the insert piece is inserted into a slit portion provided in a front part lower face of the frame and is engaged with the socket of the timing belt coupling means for connecting the timing belt so that the lever and the timing belt are fastened to each other.

18. The refrigerator according to claim 16, characterized in that a frame reinforcing plate is arranged along a track of the lever moving along the frame.

19. The refrigerator according to claim 1 or 16 characterized in that a front part of the frame is a metal frame, and the timing belt is arranged inside the metal frame.

20. The refrigerator according to claim 1, characterized in that the shelf device comprises a removable shelf placed on the frame, and the removable shelf is provided with a lower front part having a U-shaped rib opening forward so as to be engaged with a flange portion formed at a front side inner edge of the frame, and a L-shaped rear part so as to cover a rear part of the frame.

21. The refrigerator according to claim 11, characterized in that the gear fixedly provided in the screw shape shaft is provided with a plurality of rotatable balls which are embedded inside the gear, and an upper supporting shaft which is rotatably engaged with the gear with intervention of the rotatable balls, the frame is provided with a bearing portion having a hole, and the upper supporting shaft is set to the frame, with its upper end inserted in the hole of the bearing portion, so that the gear can rotate.

22. The refrigerator according to claim 21, characterized in that the upper face of the rotatable balls is protruded from the upper face of the gear, and the gear rotates while the lower face of the bearing portion of the frame gets in contact with the rotatable balls.

23. The refrigerator according to claim 16, characterized in that the timing belt is attached to the timing belt coupling means in such a manner that in the case where the lever is slid in the right direction in its operation to lift up the shelf, one end of the timing belt is fixed to the socket of the timing belt coupling means on the left side while the other end of the timing belt is connected to the slider portion of the timing belt coupling means on the right side, and in the case where the lever is slid in the left direction in its operation to lift up the shelf, one end of the timing belt is fixed to the socket of the timing belt coupling means on the right side while the other end of the timing belt is connected to the slider portion of the timing belt coupling means on the left side.

24. The refrigerator according to claim 1, characterized in that the shelf provided on the frame is made of a resin, and a metal member is placed on the upper face of the shelf.

25. The refrigerator according to claim 1, characterized in that the shelf provided on the frame is made of a metal.

26. The refrigerator according to claim 24 or 25, characterized in that part of cool air led to an inside of the frame blows against the metal member or the metal shelf provided on the frame.

27. The refrigerator according to claim 1, characterized in that a knob shape of the lever is formed into a recess dented toward the inner side, corresponding to an abdominal portion of a finger.

* * * * *